US010612321B2

(12) United States Patent
Moss et al.

(10) Patent No.: US 10,612,321 B2
(45) Date of Patent: Apr. 7, 2020

(54) STAND BUILDING USING A HORSESHOE SLIP ELEVATOR

(71) Applicant: Frank's International, LLC, Houston, TX (US)

(72) Inventors: Alfred Moss, Lafayette, LA (US); Nicholas Guidry, Breaux Bridge, LA (US); Logan Smith, Lafayette, LA (US); Dax Joseph Neuville, Broussard, LA (US); Dougal Brown, Scotland (GB)

(73) Assignee: FRANK'S INTERNATIONAL, LLC, Houston, TX (US)

( * ) Notice: Subject to any disclaimer, the term of this patent is extended or adjusted under 35 U.S.C. 154(b) by 0 days.

(21) Appl. No.: 16/258,859

(22) Filed: Jan. 28, 2019

(65) Prior Publication Data

US 2019/0153789 A1 May 23, 2019

Related U.S. Application Data

(63) Continuation-in-part of application No. 15/718,925, filed on Sep. 28, 2017, now Pat. No. 10,570,678.
(Continued)

(51) Int. Cl.
*E21B 19/15* (2006.01)
*E21B 19/20* (2006.01)
(Continued)

(52) U.S. Cl.
CPC ..... *E21B 19/07* (2013.01); *E21B 3/02* (2013.01); *E21B 19/10* (2013.01); *E21B 19/155* (2013.01);
(Continued)

(58) Field of Classification Search
CPC ..... E21B 19/15; E21B 19/155; E21B 19/20; E21B 19/06; E21B 19/07
See application file for complete search history.

(56) References Cited

U.S. PATENT DOCUMENTS 1,558,261 A 10/1925 Grady
1,656,582 A 1/1928 Harder
(Continued)

OTHER PUBLICATIONS

Jin Ho Kim (Authorized Officer), International Search Report and Written Opinion dated Jan. 25, 2018, PCT Application No. PCT/US2017/055491, filed Oct. 6, 2017, pp. 1-17.
(Continued)

*Primary Examiner* — Giovanna C Wright
(74) *Attorney, Agent, or Firm* — MH2 Technology Law Group LLP

(57) ABSTRACT

A pipe racking system and method, of which the pipe racking system includes a vertical column extending upwards from a rig floor, a main arm that is movable vertically along the column, a gripper connected to a distal end of the main arm and movable therewith, and an elevator including a plurality of slips configured to engage an outer diameter surface of a tubular and support a weight of the tubular by gripping the outer surface of the tubular. The elevator is suspended from the gripper or a distal end of the main arm via one or more suspension arms. The system also includes one or more guide arms connected to the vertical column. The one or more guide arms are configured to maintain a vertical orientation of the tubular.

6 Claims, 29 Drawing Sheets

Related U.S. Application Data

(60) Provisional application No. 62/407,018, filed on Oct. 12, 2016.

(51) Int. Cl.

| | |
|---|---|
| ***E21B 19/07*** | (2006.01) |
| ***E21B 19/10*** | (2006.01) |
| ***E21B 3/02*** | (2006.01) |
| ***E21B 19/16*** | (2006.01) |

(52) U.S. Cl.
CPC ..... *E21B 19/163* (2013.01); *E21B 19/20* (2013.01); *E21B 19/16* (2013.01)

(56) References Cited

U.S. PATENT DOCUMENTS

| | | | | |
|---|---|---|---|---|
| 2,203,118 | A | 6/1940 | Williams | |
| 8,632,111 | B2 * | 1/2014 | Krijnen | E21B 19/20 294/91 |
| 2007/0261857 | A1 * | 11/2007 | Kuttel | E21B 19/06 166/380 |
| 2008/0060818 | A1 | 3/2008 | Bourgeois et al. | |
| 2008/0277108 | A1 | 11/2008 | Bouligny, Jr. et al. | |
| 2010/0319932 | A1 | 12/2010 | Angelle | |
| 2012/0085550 | A1 | 4/2012 | Robichaux et al. | |
| 2014/0090856 | A1 * | 4/2014 | Pratt | E21B 19/06 166/380 |
| 2015/0159444 | A1 | 6/2015 | Stankovic | |
| 2015/0240575 | A1 | 8/2015 | Angelle et al. | |

OTHER PUBLICATIONS

Non-Final Office Action dated Mar. 7, 2019, U.S. Appl. No. 15/718,925, filed Sep. 28, 2017, pp. 1-16.

Athina Nickitas-Etienne (Authorized Officer), International Preliminary Report on Patentability dated Apr. 25, 2019, PCT Application No. PCT/US2017/055491, pp. 1-14.

* cited by examiner

STAND BUILDING USING A HORSESHOE SLIP ELEVATOR

CROSS-REFERENCE TO RELATED APPLICATIONS

This application is a continuation-in-part of U.S. patent application Ser. No. 15/718,925, filed on Sep. 28, 2017, which claims priority to U.S. Provisional Patent Application No. 62/407,018, filed on Oct. 12, 2016. The entirety of each of these priority applications is incorporated herein by reference.

BACKGROUND

Elevators are used in the oilfield industry for handling tubulars on drilling rigs. Some elevators include a body made up of two semi-circular portions that are hinged together and fitted around a tubular. A latch or connecting pin may be positioned opposite of the hinge to secure the semi-circular portions together. When disengaged, the latch or connecting pin allows for the semi-circular portions to be pivoted apart. Another type of elevator is in the shape of a horseshoe. Horseshoe-shaped elevators generally do not require disengaging a latch or connecting pin and pivoting the semi-circular portions apart to place the elevator around the tubular.

Horseshoe-shaped elevators are generally designed to support a tubular by lifting on the lower load face of a coupling that has been connected ("made up") to the tubular. The coupling has a bore formed therethrough and female threads on an inner surface thereof. The coupling is designed to have two tubulars inserted into the bore through opposing ends of the coupling. Male threads on the tubulars may engage corresponding female threads of the coupling to join the tubulars together. As such, the outer diameter of the coupling is larger than the outer diameter of the tubulars. Thus, an upper surface of the elevator may contact a lower surface of the coupling, thereby allowing the elevator to support the weight of the tubular.

When no coupling is used, a lifting apparatus (often referred to as a "lift nubbin" or "lift plug") is coupled to the tubular. The lifting apparatus includes a male threaded end that engages the female threads in the tubular. The lifting apparatus includes a flange portion on the outer diameter thereof that is larger than the outer diameter of the tubular. The elevator may contact a lower surface of the flange, thereby allowing the elevator to support the weight of the tubular. Attaching and removing lifting apparatuses, however, lengthens time taken to deploy each tubular into the well, as the lifting apparatus generally has to be installed and then removed before the tubular is made up to the next tubular.

As shown in FIGS. 19 and 20, a clamp-type elevator 1900 was created to avoid the use of lifting apparatuses. The clamp-type elevator 1900 includes tapered slips that are fitted with gripping inserts that are configured to radially-grip the outer diameter of the tubular. At least one of the slips 1911, 1912 is spring-biased upward, and at least one of the slips 1913, 1914 is pneumatically powered up and down. The operation of the clamp-type elevator 1900 involves laterally moving the elevator onto the tubular to be lifted. The front slip arms 1930, 1931 pivot about shafts 1940, 1941 into the deployed position shown in FIG. 19 and move the pneumatic slip(s) 1913, 1914 downward into initial engagement with the tubular 1920. As the tubular 1920 is lifted, the spring-biased slip(s) 1911, 1912 are drawn downward into increased radial gripping engagement with the tubular 1920.

In certain applications, the spring-biased slip(s) 1911, 1912 are drawn downward into contact with the tubular 1920 to be lifted prior to the pneumatic slips 1913, 1914 being energized. When this occurs, the spring-biased slip(s) 1911, 1912 may mechanically overload and fracture a mechanical stop that is designed to stop movement of the spring-biased slip(s) 1911, 1912 at the end of their downward stroke. Once this occurs, the slip becomes separated from the clamp-type elevator 1900 and becomes a dropped object. In some instances, this may cause the tubular 1920 to be dropped.

To reduce the run-in and trip-out time for tubulars, two, three, or more joints of tubulars are often pre-assembled into stands, which are then stored in racks, generally in a vertical orientation, for subsequent use. As noted above, lift nubbins are often used in the absence of drill collars, providing a shoulder for the elevator to engage and lift the tubular. As stands are being built, this presents two issues. First, each tubular requires a lift nubbin, and thus time is expended connecting and disconnecting lift nubbins. Further, the upper-most tubular supports the lower tubulars and is put into the rack ("racked-back") with a lift nubbin at the top, and thus a rig operator is called upon to work at the top of the rack (which can be 40 feet or more above the rig floor) to disgengage the lift nubbin, or the lift nubbin may be left in place, which can require potentially hundreds of lift nubbins to be available on the rig.

SUMMARY

A pipe racking system is disclosed. The pipe racking system includes a vertical column extending upwards from a rig floor, a main arm that is movable vertically along the column, a gripper connected to a distal end of the main arm and movable therewith, and an elevator including a plurality of slips configured to engage an outer diameter surface of a tubular and support a weight of the tubular by gripping the outer surface of the tubular. The elevator is suspended from the gripper or a distal end of the main arm via one or more suspension arms. The system also includes one or more guide arms connected to the vertical column. The one or more guide arms are configured to maintain a vertical orientation of the tubular.

A method for building a stand of tubulars is also disclosed. The method includes lowering a main arm of a pipe racking system toward a rig floor along a vertical column. The pipe racking assembly includes a gripper coupled to an end of the main arm, and an elevator suspended from the gripper or end of the main arm by one or more suspension arms. The method also includes pivoting the elevator so as to receive a first tubular into a throat of the elevator, engaging the first tubular using slips of the elevator, and raising the main arm with respect to the rig floor. Raising the main arm causes the elevator and the first tubular engaged by the elevator to raise. The method also includes lowering the tubular into the well or mousehole by lowering the main arm and the elevator, gripping and supporting the first tubular at the well or mousehole using a supporting device, releasing the first tubular from the elevator, pivoting the elevator so as to receive a second tubular into a throat of the elevator, engaging the second tubular using slips of the elevator, and raising the main arm with respect to the rig floor. Raising the main arm causes the elevator and the second tubular engaged by the elevator to raise. The method also includes lowering the second tubular into contact with the first tubular by lowering the main arm and the elevator, rotating the second tubular with respect to the first tubular, to secure a connection therebetween and thereby form at least part of a tubular stand, gripping the tubular stand using the gripper, and raising the tubular stand by raising the main arm along the vertical column.

The foregoing summary is intended merely to introduce a subset of the features more fully described of the following detailed description. Accordingly, this summary should not be considered limiting.

BRIEF DESCRIPTION OF THE DRAWINGS

The accompanying drawing, which is incorporated in and constitutes a part of this specification, illustrates an embodiment of the present teachings and together with the description, serves to explain the principles of the present teachings. In the figures.

Figure 1:
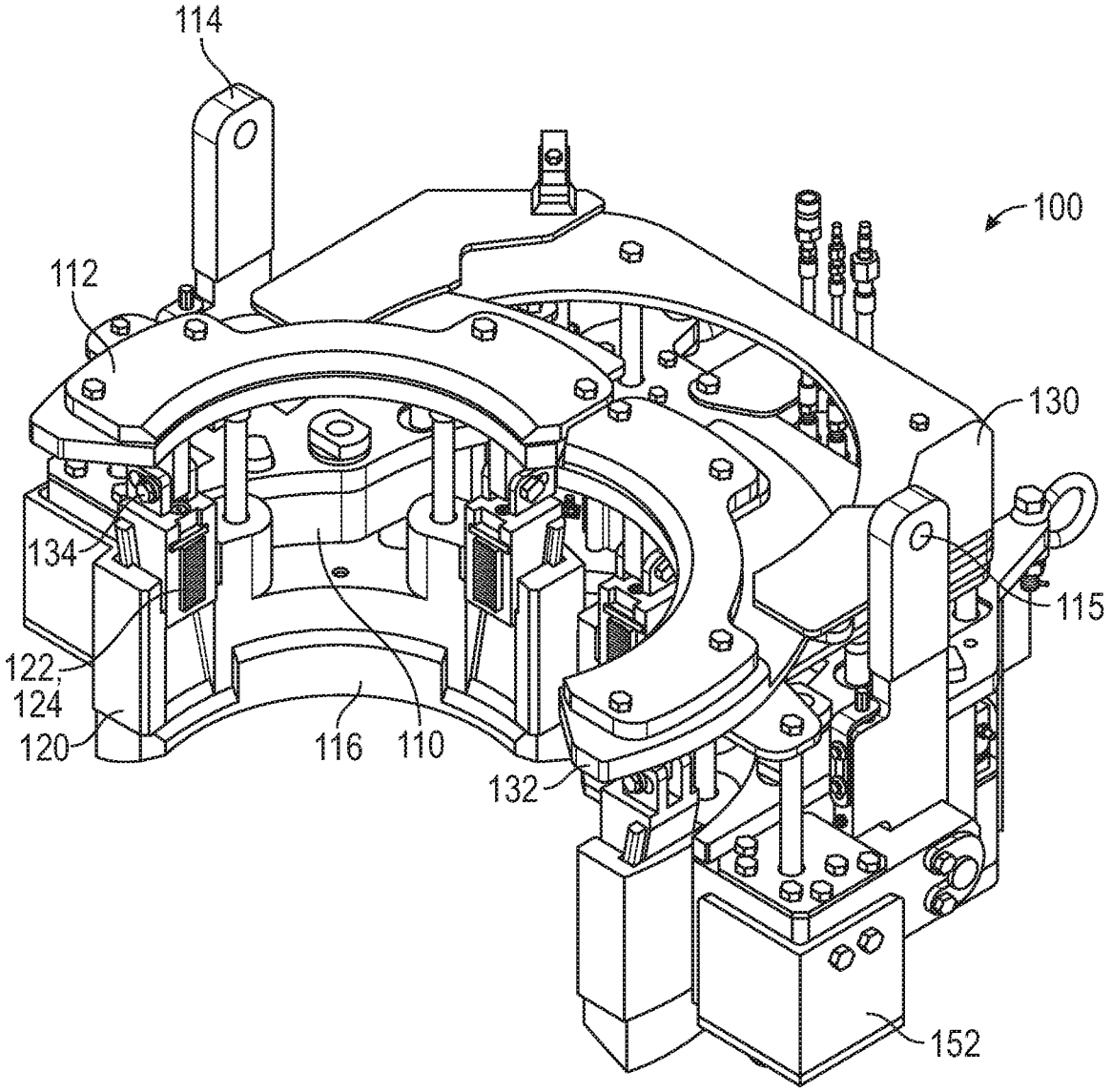
FIG. 1 illustrates a perspective view of an apparatus for gripping a tubular, showing slip carriers thereof in an open position and slips thereof in an up position, according to an embodiment.

It should be noted that some details of the figure have been simplified and are drawn to facilitate understanding of the embodiments rather than to maintain strict structural accuracy, detail, and scale.

DETAILED DESCRIPTION

Reference will now be made in detail to embodiments of the present teachings, examples of which are illustrated in the accompanying drawing. In the drawings, like reference numerals have been used throughout to designate identical elements, where convenient. In the following description, reference is made to the accompanying drawing that forms a part thereof, and in which is shown by way of illustration a specific exemplary embodiment in which the present teachings may be practiced. The following description is, therefore, merely exemplary.

Figure 2:
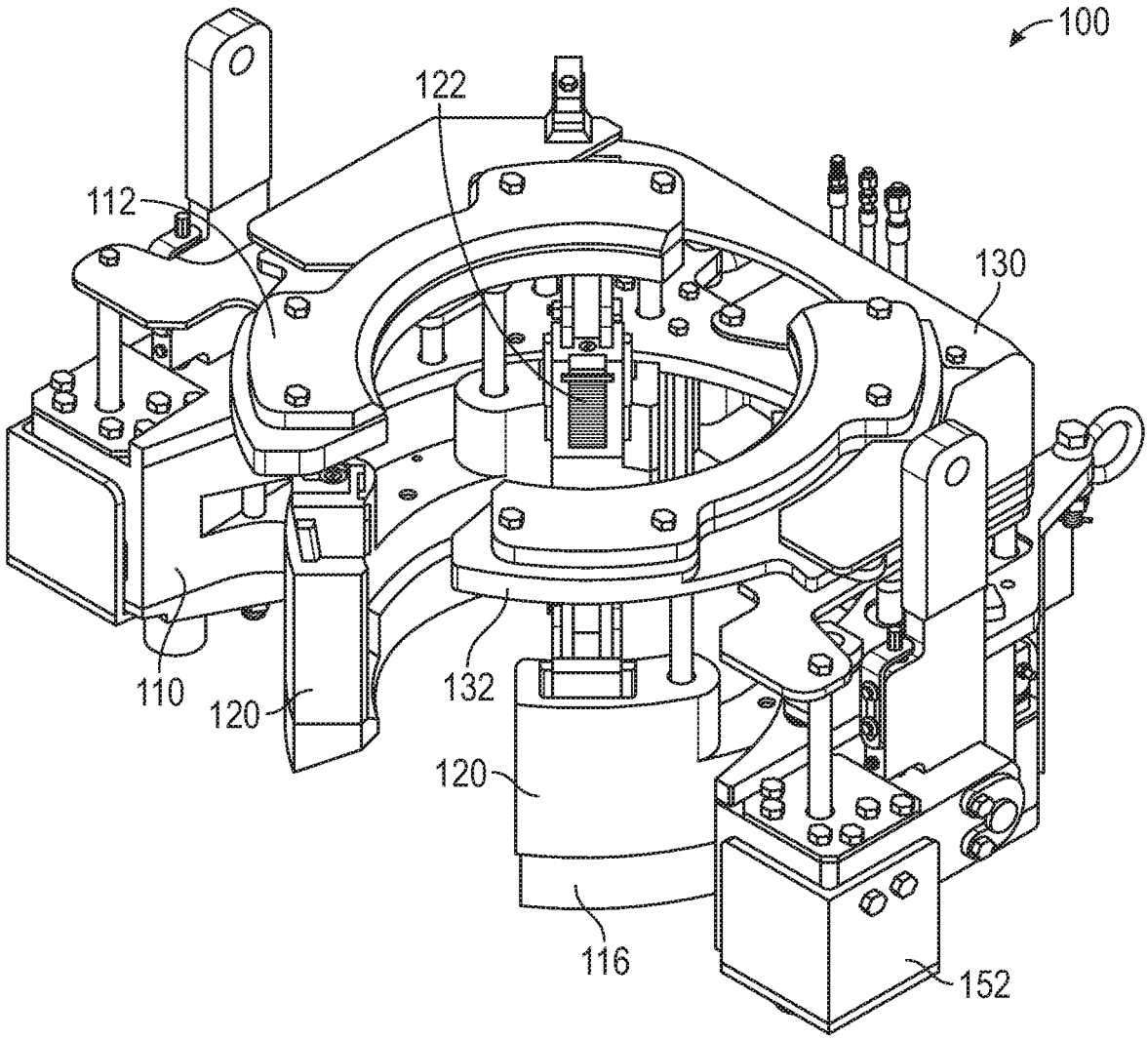
FIG. 2 illustrates another perspective view of the apparatus showing the slip carriers in a closed position and the slips in the up position, according to an embodiment.
Figure 3:
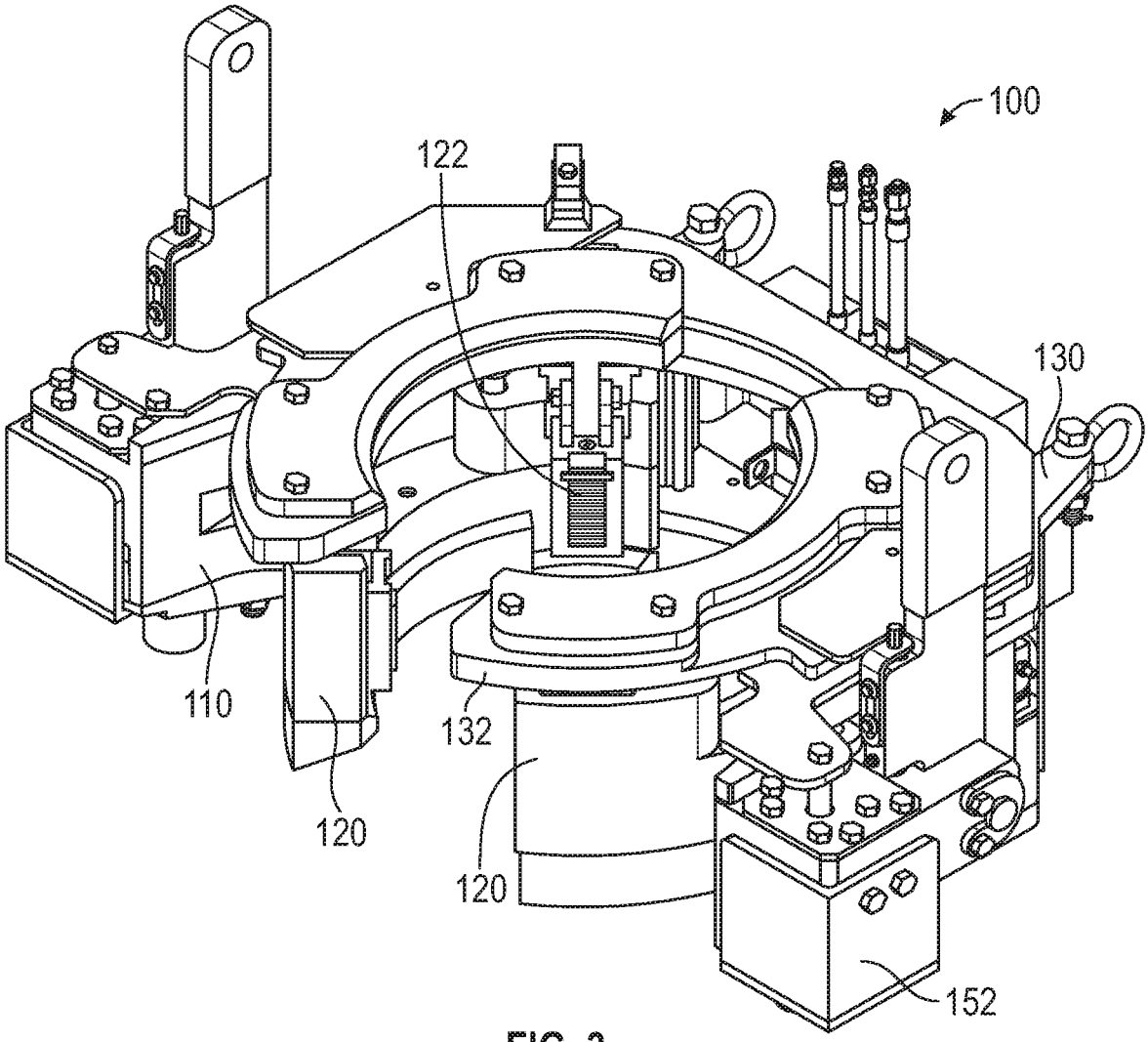
FIG. 3 illustrates another perspective view of the apparatus showing the slip carriers in the closed position and the slips in a down position, according to an embodiment.

FIGS. 1-3 illustrate perspective views of an apparatus 100 for gripping a tubular, according to an embodiment. The apparatus 100 may be or include a horseshoe-type slip elevator. The apparatus 100 may be used to grip and lift tubulars from a substantially horizontal orientation (e.g., when the tubulars are presented at an entrance to the rig floor and/or derrick) to a substantially vertical orientation. The tubulars may be or include segments/joints of casing, liner, drill pipe, completion tubing, or the like. The apparatus 100 may also be used for raising and/or lowering the tubular(s) that are vertically oriented to facilitate joining the tubular(s) into assemblies of two or three or four or more tubulars to form a stand. Further, the apparatus 100 may be used to deliver individual tubulars or stands to the well center to facilitate joining the tubular or stand into a full string of tubulars that is lowered into the wellbore.

The apparatus 100 may include a body 110 that is substantially U-shaped (i.e., horseshoe-shaped). The body 110 may have one or more top guides 112 coupled thereto or integral therewith. The top guides 112 may be configured to actuate between a first, open position and a second, closed position. The top guides 112 are shown in the open position in FIG. 1 and in the closed position in FIG. 2. When the top guides 112 are in the open position, a tubular may be inserted laterally into the body 110, such that the apparatus 100 is received at least partially around the tubular. When the top guides 112 are in the closed position, the tubular may not be inserted laterally into or removed laterally from the body 110. The body 110 may also include one or more lift points (two are shown: 114, 115) that may be used to lift the body 110 and any tubulars engaged with the apparatus 100. The lift points 114, 115 may be positioned symmetrically around a centerline through the body 110.

The body 110 may have one or more bottom guides 116 coupled thereto or integral therewith. The bottom guides 116 are shown in the open position in FIG. 1 and in the closed position in FIG. 2. When the bottom guides 116 are in the open position, a tubular may be inserted laterally into the body 110, and when the bottom guides 116 are in the closed position, the tubular may not be inserted laterally into or removed laterally from the body 110. The bottom guides 116 may have a beveled inner diameter to guide the apparatus 100 over the end of the tubular in cases where the apparatus 100 is lowered vertically over the end of the tubular.

The apparatus 100 may also include one or more slip carriers 120. The slip carriers 120 may be or include arcuate segments. The slip carriers 120 may be pivotally coupled to the body 110 and positioned in receptacles that are defined in the body 110. The slip carriers 120 may act as doors that pivot/rotate between a first (e.g., open) position and a second (e.g., closed) position. The slip carriers 120 are shown in the open position in FIG. 1. In the open position, a tubular may be introduced laterally into the body 110 of the apparatus 100. The slip carriers 120 are shown in the closed position in FIGS. 2 and 3. In the closed position, the tubular may not be introduced laterally into or removed laterally from the body 110 of the apparatus 100.

The apparatus 100 may also include one or more slips 122. The slips 122 may be coupled to the slip carriers 120. For example, two slips 122 may be coupled to each slip carrier 120. The slips 122 may be wedge-shaped elements that have one or more gripping elements (e.g., provided on inserts 124) on a front/inner radial surface thereof for engaging and gripping the tubular. A back/outer radial surface of the slips 122 may be configured to mate with and slide along a tapered receptacle of the slip carriers 120. The slips 122 are shown in a first (e.g., up) position in FIGS. 1 and 2. In the up position, the slips 122 are positioned a first radial distance from the centerline through the body 110 such that the slips 122 are not configured to contact a tubular positioned within the apparatus 100. The slips 122 may be retracted underneath the top guides 112 when in the up position. The slips 122 are shown in a second (e.g., down) position in FIG. 3. In the down position, the slips 122 are positioned a second radial distance from the centerline through the body 110 that is less than the first radial distance. In the second position, the slips 122 are configured to contact a tubular positioned within the apparatus 100. Thus, the slips 122 move radially-inward as they move downward and radially-outward as they move upward. The slips 122 may include one or more gripping inserts 124 on the inner radial surfaces thereof. The gripping inserts 124 are configured to contact and grip the tubular. The apparatus 100 may be configured to grip and move tubulars of different sizes by replacing one or more of the components (e.g., top guides 112, slips 122, gripping inserts 124, etc.) with components of a different size.

The apparatus 100 may also include a main timing ring 130, as shown in FIGS. 1-3. The main timing ring 130 may be or include a semi-circular plate that is moved vertically upward and downward. The main timing ring 130 may be moved by one or more pneumatic cylinders 152 that are coupled to the body 110.

The apparatus 100 may also include one or more slip carrier timing rings 132, as shown in FIGS. 1-3. The slip carrier timing rings 132 may be or include arcuate plates that are similar in shape and size to the slip carriers 120. The top guide 112 may be coupled (e.g., bolted) to the top of the slip carrier timing rings 132. The slip carrier timing rings 132 may be coupled to guide rods that allow the slip carrier timing rings 132 to move vertically upward and downward with respect to the slip carriers 120.

The slip carrier timing rings 132 may have an interlocking engagement with the main timing ring 130. When the main timing ring 130 is moved upward or downward, the slip carrier timing rings 132 may move together with the main timing ring 130 due to the interlocking engagement. In addition, the slip carrier timing rings 132 may be coupled to the slips 122 via linkages 134. Thus, as the slip carrier timing rings 132 move upward and downward with respect to the body 110 and the slip carriers 120, the slips 122 may also move upward and downward with respect to the body 110 and the slip carriers 120. The downward movement between the slips 122 and the slip carriers 120 may cause the slips 122 to move radially-inward toward the centerline of the body 110 (e.g., to grip a tubular). Conversely, as the slips 122 move upward, they move radially-outward away from the centerline of the body 110 (e.g., to release the tubular).

The apparatus 100 may also include one or more slip lift cylinders 152 (see FIGS. 1-3). In at least one embodiment, the apparatus 100 may include four slip lift cylinders 152. The slip lift cylinders 152 may be coupled to the body 110. More particularly, the slip lift cylinders 152 may be coupled to opposing sides of the body 110, and adjacent to the lift points 114. The rod ends of each of the slip lift cylinders 152 may be coupled to the main timing ring 130. When the rods of the slip lift cylinders 152 are actuated into the extended position, the main timing ring 130 moves upward together with the slip carrier timing rings 132 and the slips 122. Conversely, when the rods of the slip lift cylinders 152 move downward, the main timing ring 130, the slip carrier timing rings 132, and the slips 122 move downward, to enable the slips 122 to engage the tubular.

Figure 4:
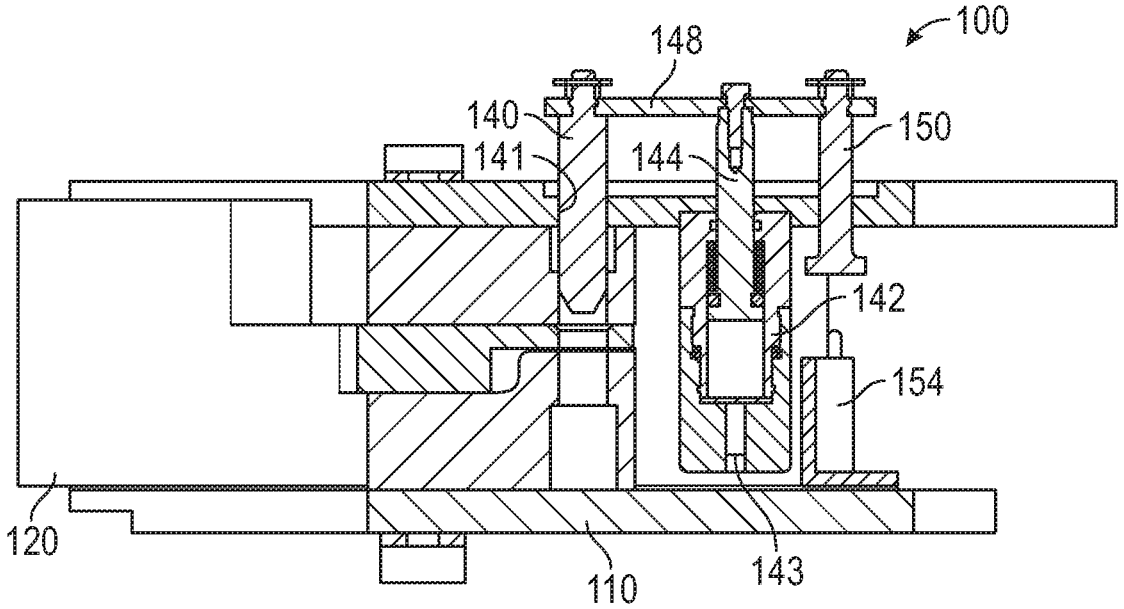
FIG. 4 illustrates a side cross-sectional view of the apparatus showing a slip carrier locking pin assembly with a locking pin in an unlocked (e.g., up) position, according to an embodiment.
Figure 5:
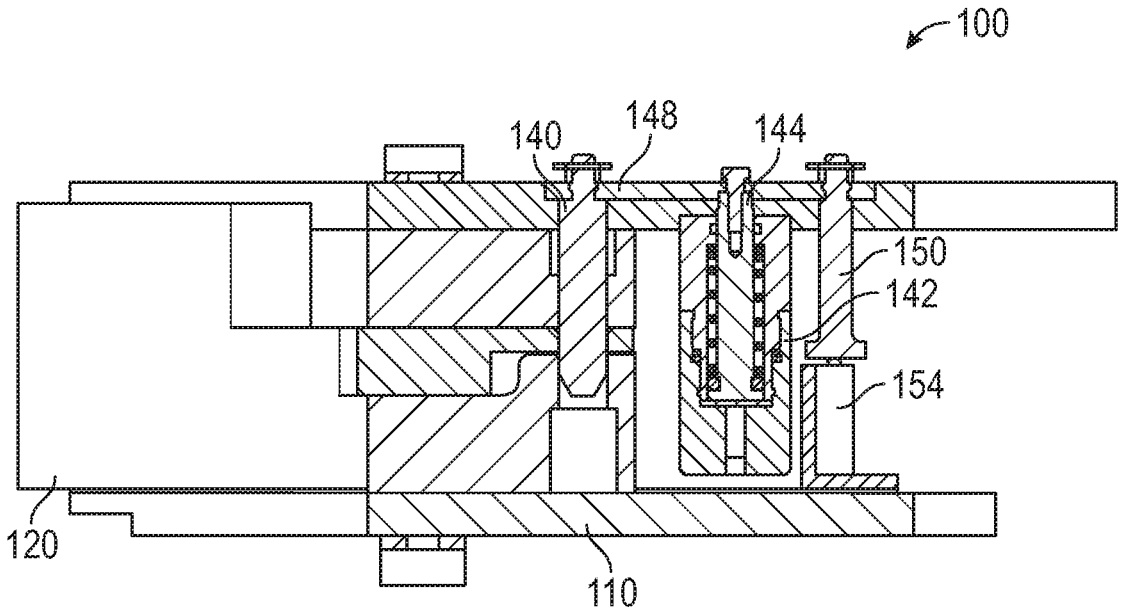
FIG. 5 illustrates a side cross-sectional view of the apparatus showing the slip carrier locking pin assembly with the locking pin in a locked (e.g., down) position, according to an embodiment.

FIG. 4 illustrates a side cross-sectional view of the apparatus 100, showing a slip carrier locking pin assembly with a locking pin 140 in an unlocked (e.g., up) position, and FIG. 5 illustrates a side cross-sectional view of the apparatus 100 showing the slip carrier locking pin assembly with the locking pin 140 in a locked (e.g., down) position, according to an embodiment. The slip carrier locking pin 140 may secure the pivoting slip carriers 120 in the closed position once the apparatus 100 has been placed at least partially around the tubular to be lifted. The slip carrier locking pin 140 may be coupled to a slip carrier locking pin cylinder 142 (described below). The slip carrier locking pin 140 may be received downward through holes 141 in the body 110 and the slip carriers 120 that are vertically-aligned when the slip carriers 120 are in the closed position. When the apparatus 100 is being removed from the tubular, the slip carrier locking pin 140 may be moved upward, which allows the slip carriers 120 to pivot into the open position, thereby creating an opening for the apparatus 100 to be moved laterally-away from the tubular.

As also shown in FIGS. 4 and 5, the slip carrier locking pin cylinders 142 may be coupled to the body 110. The slip carrier locking pin cylinders 142 may be a single-acting pneumatic cylinder with an internal coil spring that biases cylinder rods 144 into a retracted position. In other embodiments, the cylinders 142 may be hydraulic, electrical, mechanical, etc. In the illustrated pneumatic embodiment, when pneumatic pressure is applied to the extend port 143 of the slip carrier locking pin cylinders 142, the cylinder rods 144 extend. Each cylinder rod 144 may be coupled to a plate 148 that connects the cylinder rod 144 to one of the slip carrier locking pins 140 and an indicator pin 150. When the cylinder rod 144 is extended, it lifts the slip carrier locking pin 140, thereby releasing the slip carriers 120 from the body 110, allowing the slip carriers 120 to pivot into the open position.

The indicator pin 150 may be secured to the plate 148 that connects to the slip carrier locking pin cylinder 142. As such, the indicator pin 150 may move upward and downward together with the cylinder rod 144 and the slip carrier locking pin 140. When the slip carrier locking pin 140 moves downward into a "lock" position, the indicator pin 150 also moves downward, thereby activating a pneumatic indicator valve that transmits a signal to a control panel indicating that the slip carrier lock pin 140 is in the "lock" position. Alternatively, the indicator may be a hydraulic valve or an electric switch.

A logic circuit may confirm that the slip carrier locking pin 140 is in the "lock" position. The logic circuit may be located in a control panel that is separate and apart from the apparatus 100. The control panel may be where an operator interfaces with the system to send signals to open and close the slips 122. In an embodiment, the logic circuit may be at least partially pneumatic. Once the logic circuit confirms that the slip carrier locking pin 140 is in the "lock" position, a signal (e.g., a pneumatic signal) may be transmitted to the slip lift cylinders 152 (see FIGS. 1-3) that are attached to the body 110, causing the slip lift cylinders 152 to retract moving the main timing ring 130, the slip carrier timing rings 132, and the slips 122 downward, to cause the slips 122 to engage and grip the tubular.

The apparatus 100 may also include one or more slip carrier lock sensing valves 154, as shown in FIGS. 4 and 5. For example, there may be two slip carrier lock sensing valves 154, one for each slip carrier 120 in order to confirm that both slip carriers 120 are closed and locked. The slip carrier lock sensing valves 154 may be coupled to the body 110 such that a central axis of a spool within each slip carrier lock sensing valve is coaxially aligned with the indicator pin 150. The indicator pin 150 may move downward when the slip carrier locking pin cylinder 142 is retracted and the slip carrier locking pin 140 is in the locked (e.g., down) position. The downward movement of the indicator pin 150 depresses a plunger in the slip lock indicator valve 154, which sends a confirming signal to a valve that directs the slip lift cylinders 152 into the down position, thereby setting the slips 122 onto the tubular. The slip carrier lock sensing valve 154 may be in communication with the logic circuit.

Figure 6:
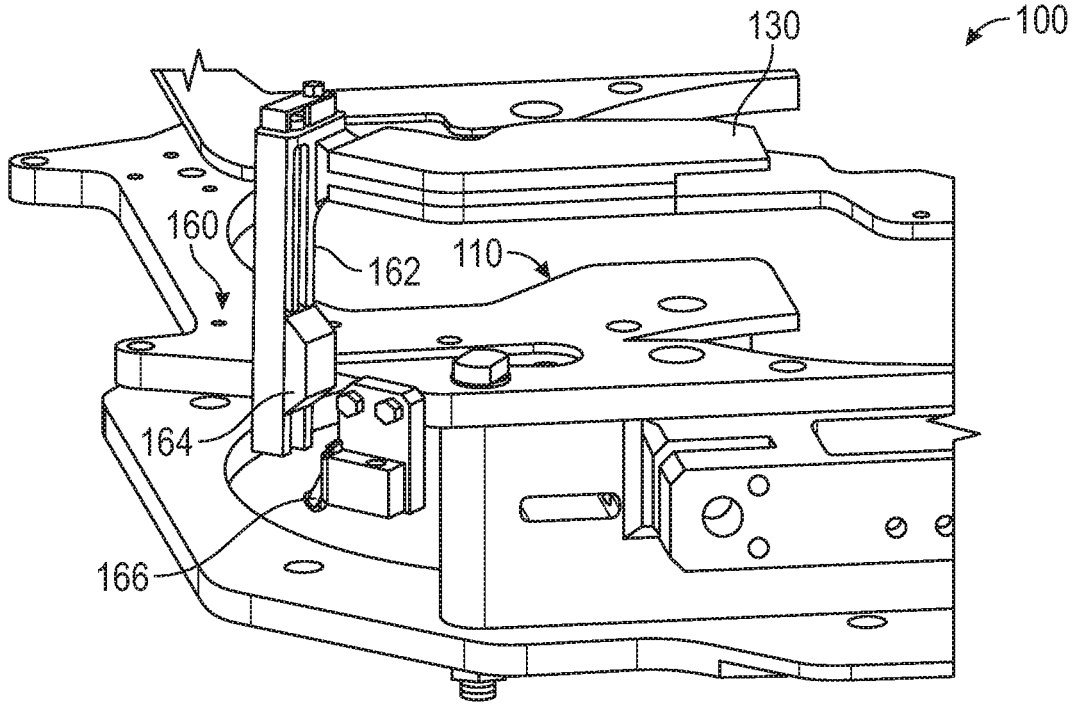
FIG. 6 illustrates a partial perspective view of the apparatus showing a slip position sensing mechanism with slips in an up position, according to an embodiment.

FIG. 6 illustrates a partial perspective view of the apparatus 100 showing a slip position sensing mechanism 160, according to an embodiment. The slip position sensing mechanism 160 may include a slip position indicator rod 162, an indicator ramp 164, and a slip position indicator valve 166. The slip position indicator rod 162 may be coupled to the main timing ring 130 and extend downward therefrom. The indicator ramp 164 may be coupled to, and configured to move with respect to, the slip position indicator rod 162. The slip position indicator valve 166 may be coupled to the body 110. When the main timing ring 130 moves downward to set the slips 122, the slip position indicator rod 162 moves together with the main timing ring 130. Movement of the indicator ramp 164 past the slip position indicator valve 166 activates the valve 166, which transmits a signal to the control panel confirming that the slips 122 are set and indicating that the tubular may be lifted.

Figure 7A:
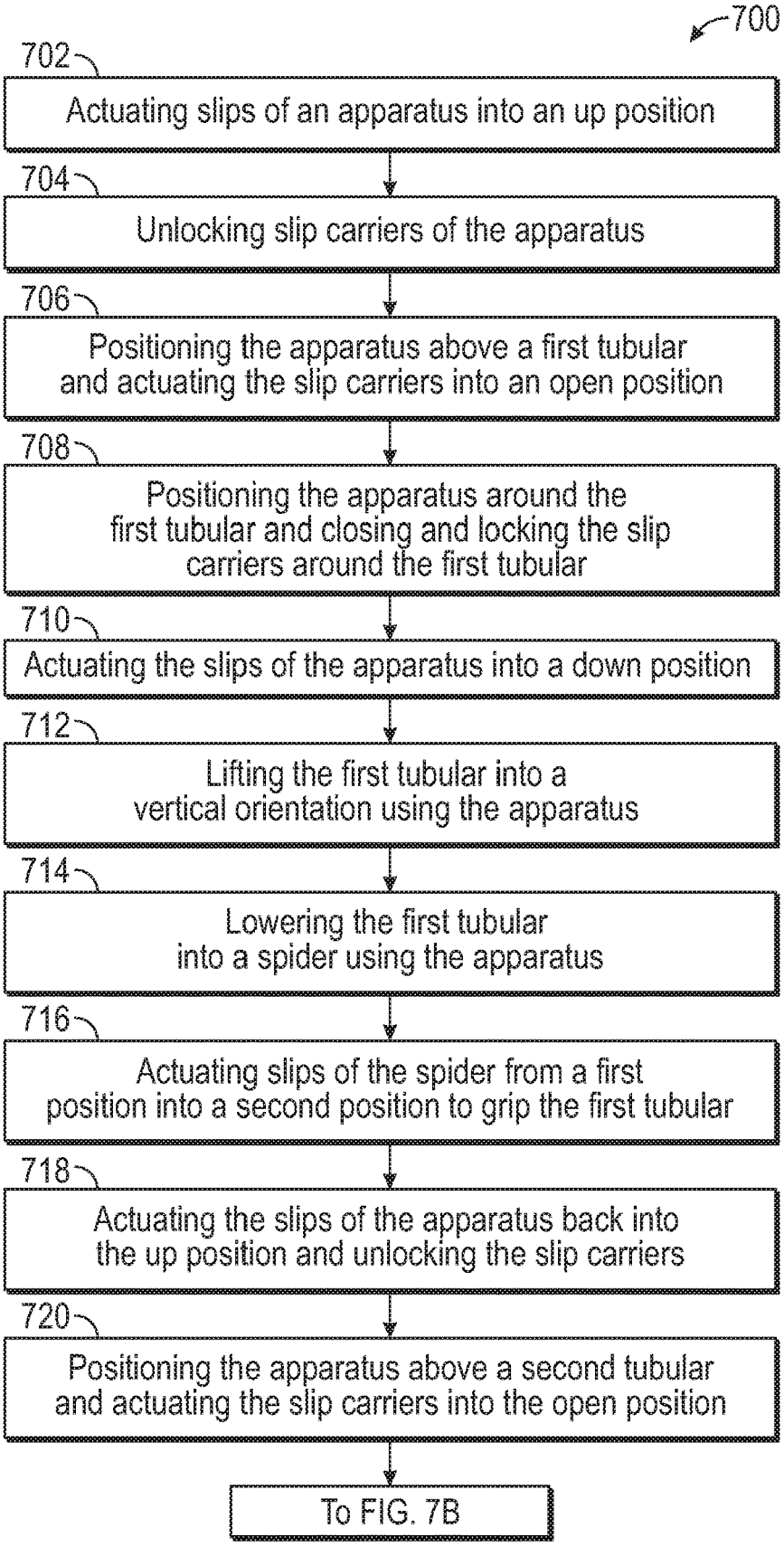
FIGS. 7A-7C illustrate a flowchart of a method for moving one or more tubulars using the apparatus, according to an embodiment.
Figure 7B:
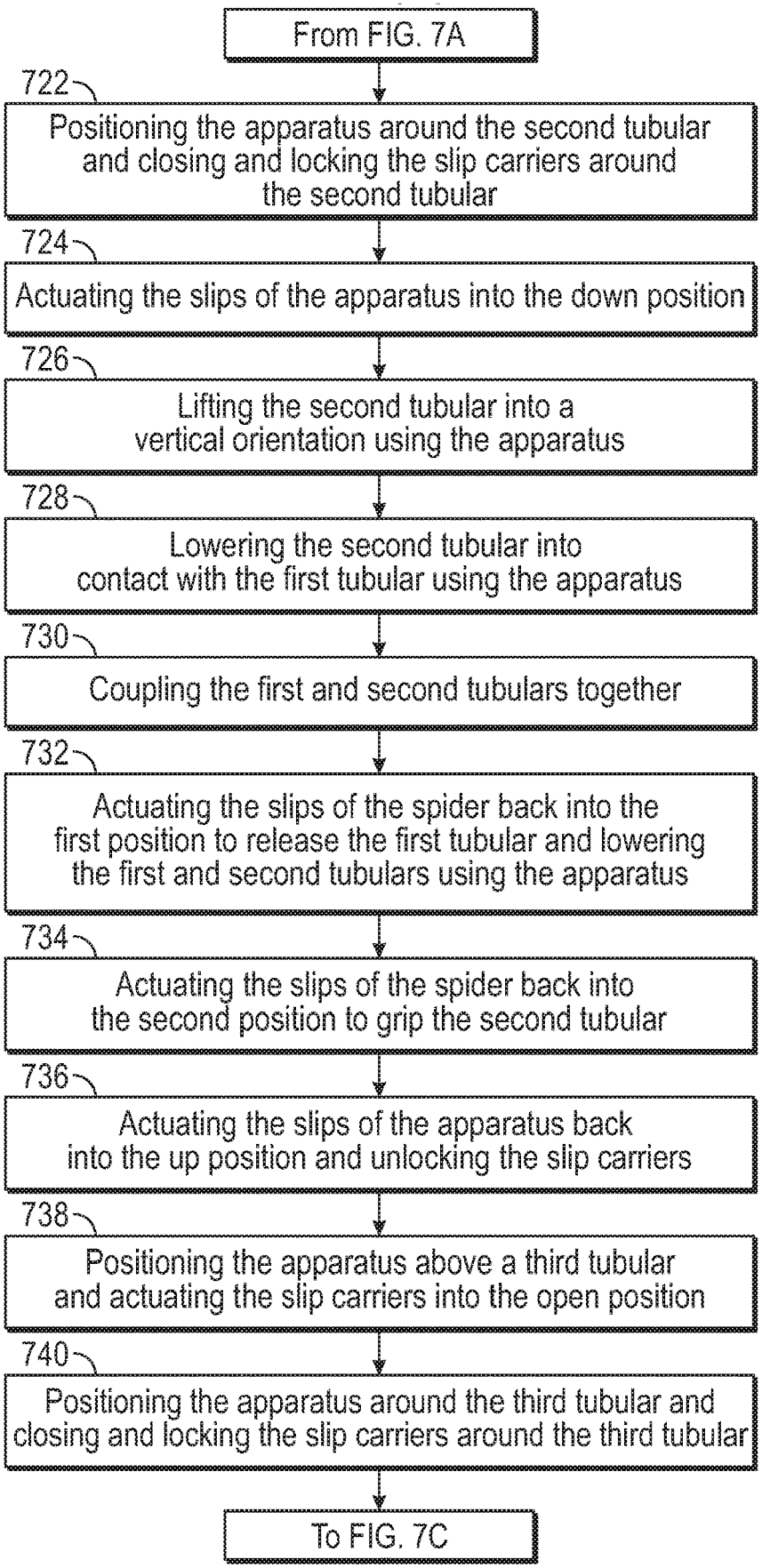
Figure 7C:
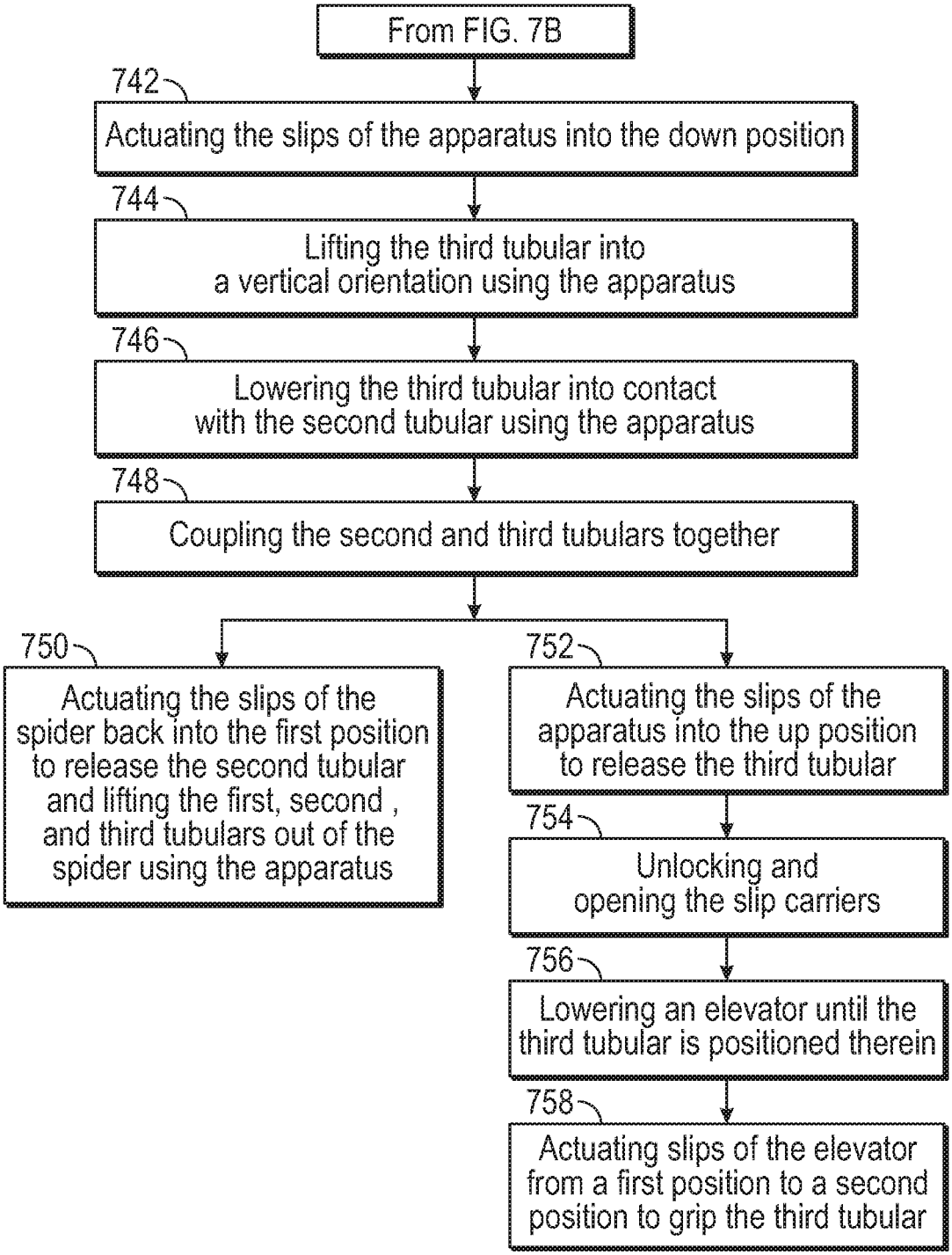
Figure 8:
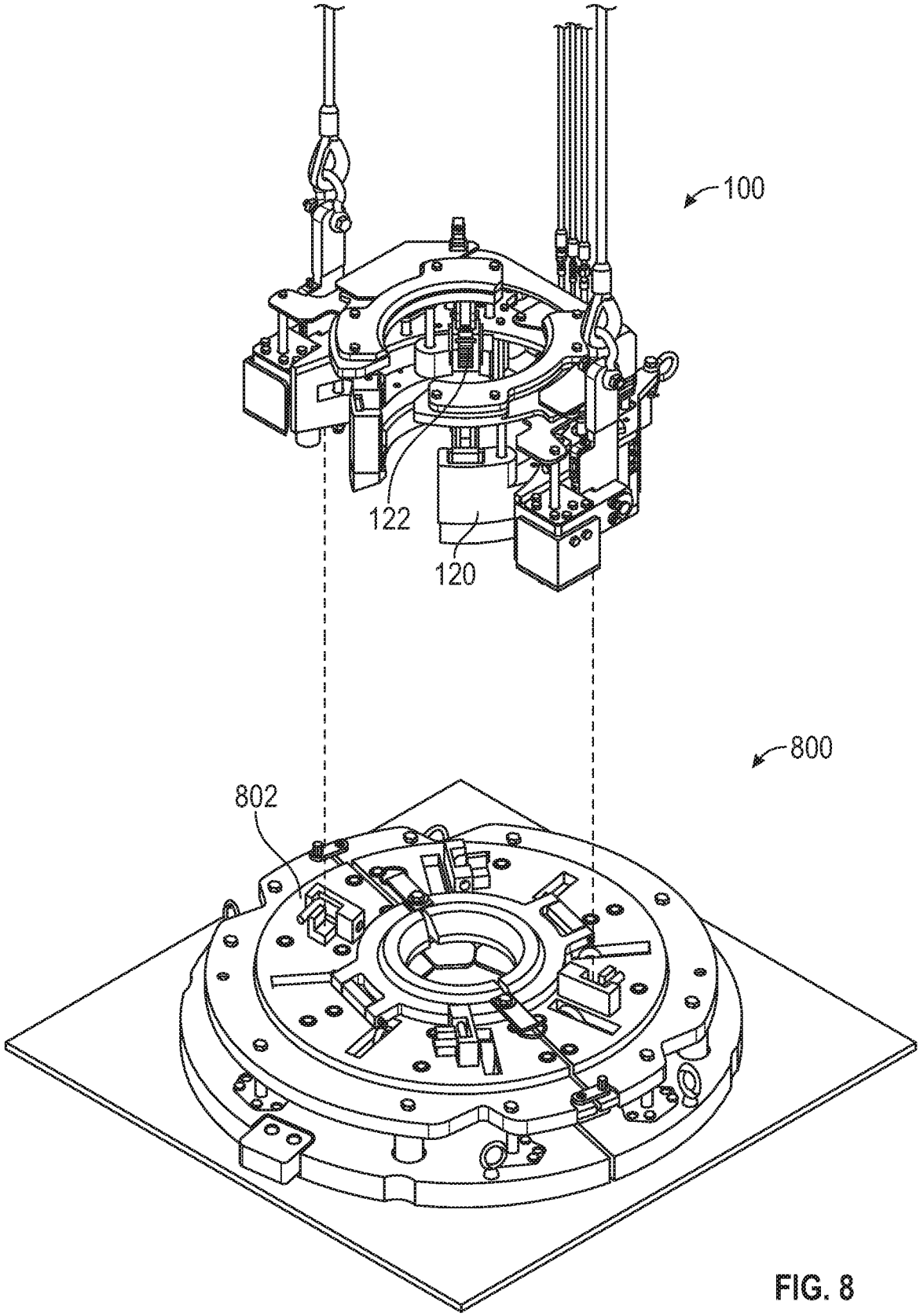
FIG. 8 illustrates an enlarged perspective view of the apparatus aligned with and positioned above well center showing the slips in the up position and the slip carriers in the closed position, according to an embodiment.

FIG. 7 is a flowchart of a method 700 for moving a first tubular 810 using the apparatus 100, according to an embodiment. The method 700 may be viewed together with FIGS. 8-17, which illustrate sequential stages of one embodiment of the method 700. The method 700 may begin with the apparatus 100 suspended above a well center 800. This is shown in FIG. 8. A tubular gripping assembly, such as a spider 802, may be positioned at the well center 800 and below the apparatus 100. The method 700 may include actuating the slips 122 into a first (e.g., up) position, as at 702. The method 700 may also include unlocking the slip carriers 120, as at 704.

Figure 9:
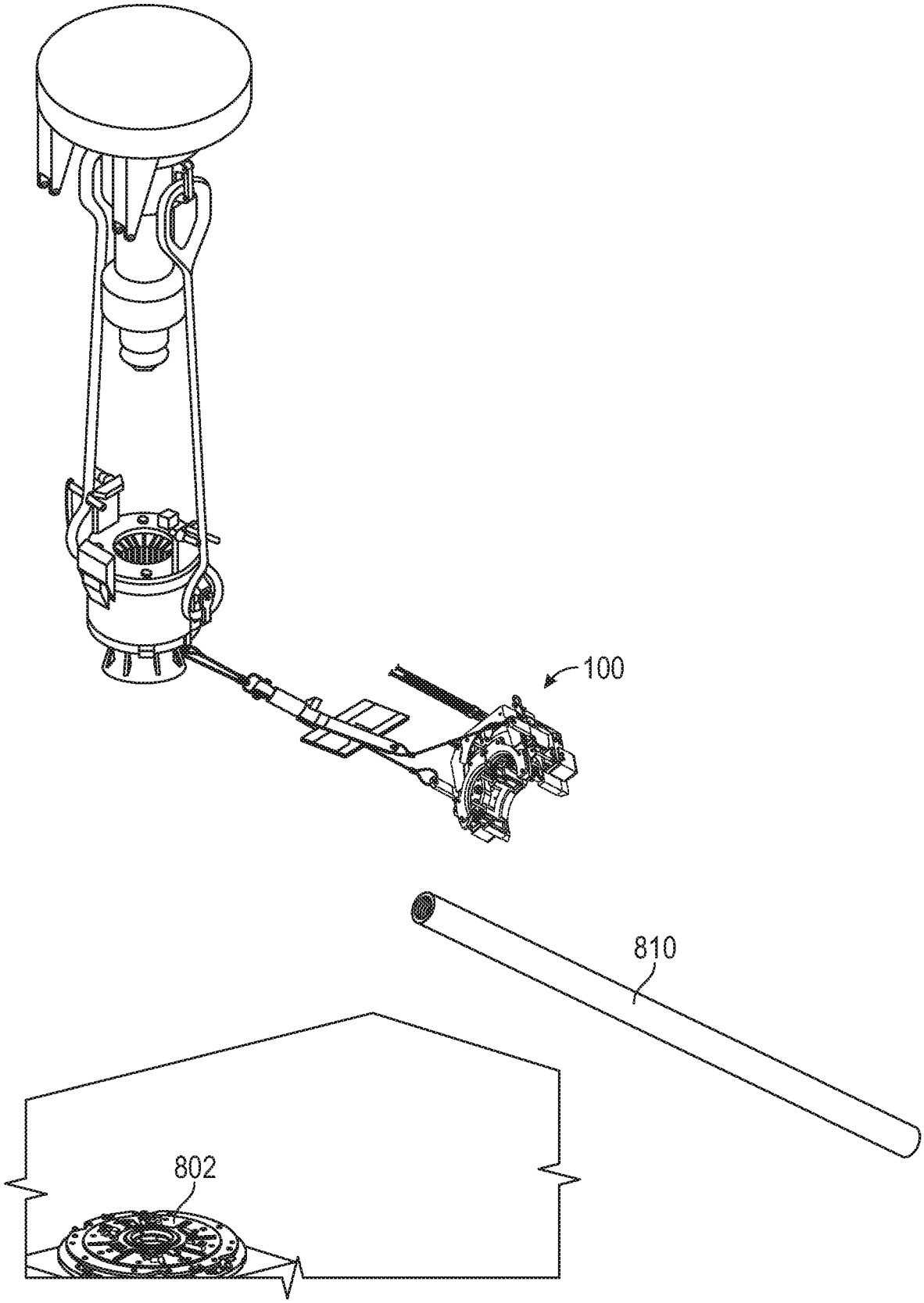
FIG. 9 illustrates a perspective view of the apparatus positioned above a first tubular with the slip carriers in the open position, according to an embodiment.

The method 700 may also include positioning the apparatus 100 above the first tubular 810 and actuating the slip carriers 120 into an open position, as at 706. This is shown in FIG. 9. The first tubular 810 may initially be substantially horizontal. In another embodiment, the first tubular 810 may be positioned in a V-door. Thus, the first tubular 810 may initially be oriented at an angle with respect to the ground. The angle may be from about 10° to about 50° or about 20° to about 40°. Although not shown, in another embodiment, the slip carriers 120 may be closed and locked while being positioned around a tubular 810. In this embodiment, the apparatus 100 may be lowered over the top of a tubular 810 when the tubular 810 is substantially vertical.

Figure 10:
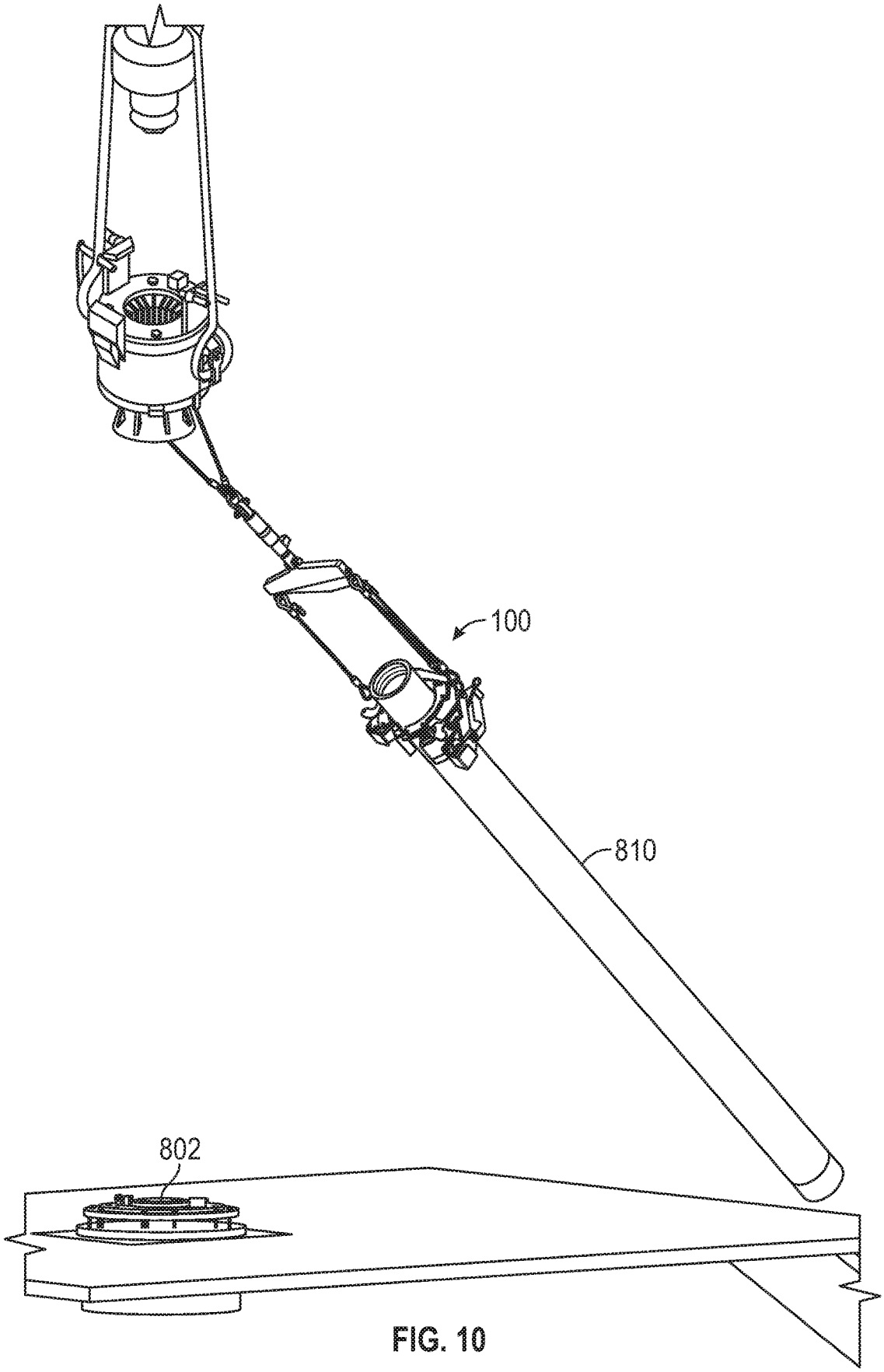
FIG. 10 illustrates a perspective view of the first tubular positioned within the apparatus and the slip carriers in the closed and locked position, according to an embodiment.

The method 700 may also include positioning the apparatus 100 at least partially around the first tubular 810 and closing and locking the slip carriers 120 around the first tubular 810, as at 708. This is shown in FIG. 10. The slip carriers 120 may be in the open position and pointing downward over the first tubular 810 as the apparatus 100 is lowered. As the apparatus 100 is positioned at least partially around the first tubular 810, the contact between the first tubular 810 and the slip carriers 120 may cause the slip carriers 120 to rotate into the closed and locked position without any manual intervention or powered actuators being required to close the slip carriers 120. More particularly, the shape of the slip carriers 120 and the location of the pivot pin allow the first tubular 810 to rotate the slip carriers 120 as the first tubular 810 moves into the throat of the apparatus 100. The slips 122 may be spaced radially-apart from the first tubular 810 when the slip carriers 120 are closed and locked and the slips 122 are in the first position.

The method 700 may also include actuating the slips 122 into a second (e.g., down) position, as at 710. The second position of the slips 122 may be downward and radially-inward with respect to the first position. Thus, the slips 122 may contact and grip the first tubular 810 when in the second position.

Figure 11:
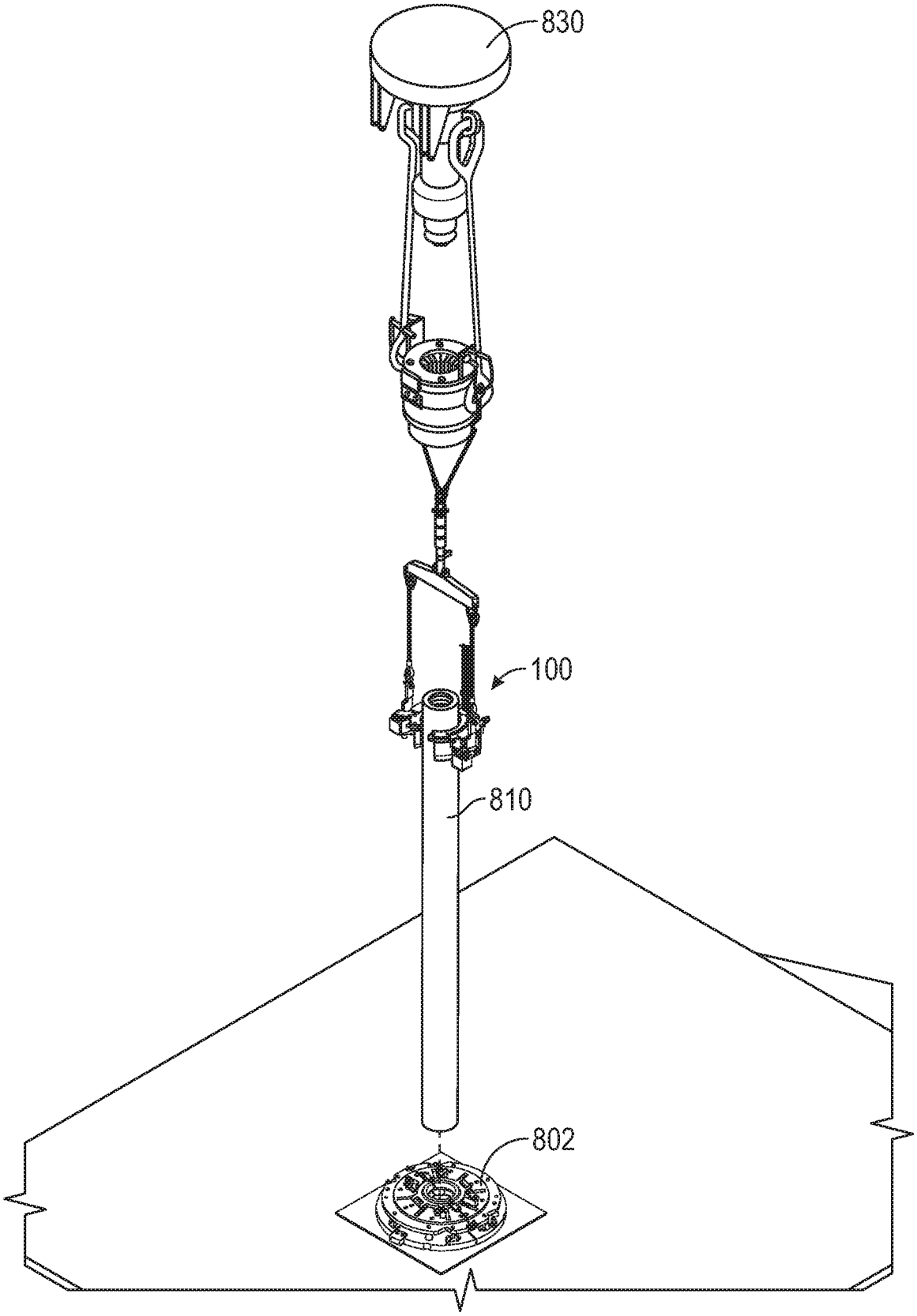
FIG. 11 illustrates a perspective view of the apparatus suspending the first tubular in the vertical orientation over the well center, according to an embodiment.

The method 700 may also include lifting the first tubular 810 into a substantially vertical orientation using a top drive 830 while the first tubular 810 is gripped by the apparatus 100, as at 712. This is shown in FIG. 11. In the substantially vertical orientation, the first tubular 810 may be positioned above and aligned with the well center 800 (e.g., the spider 802).

Figure 12:
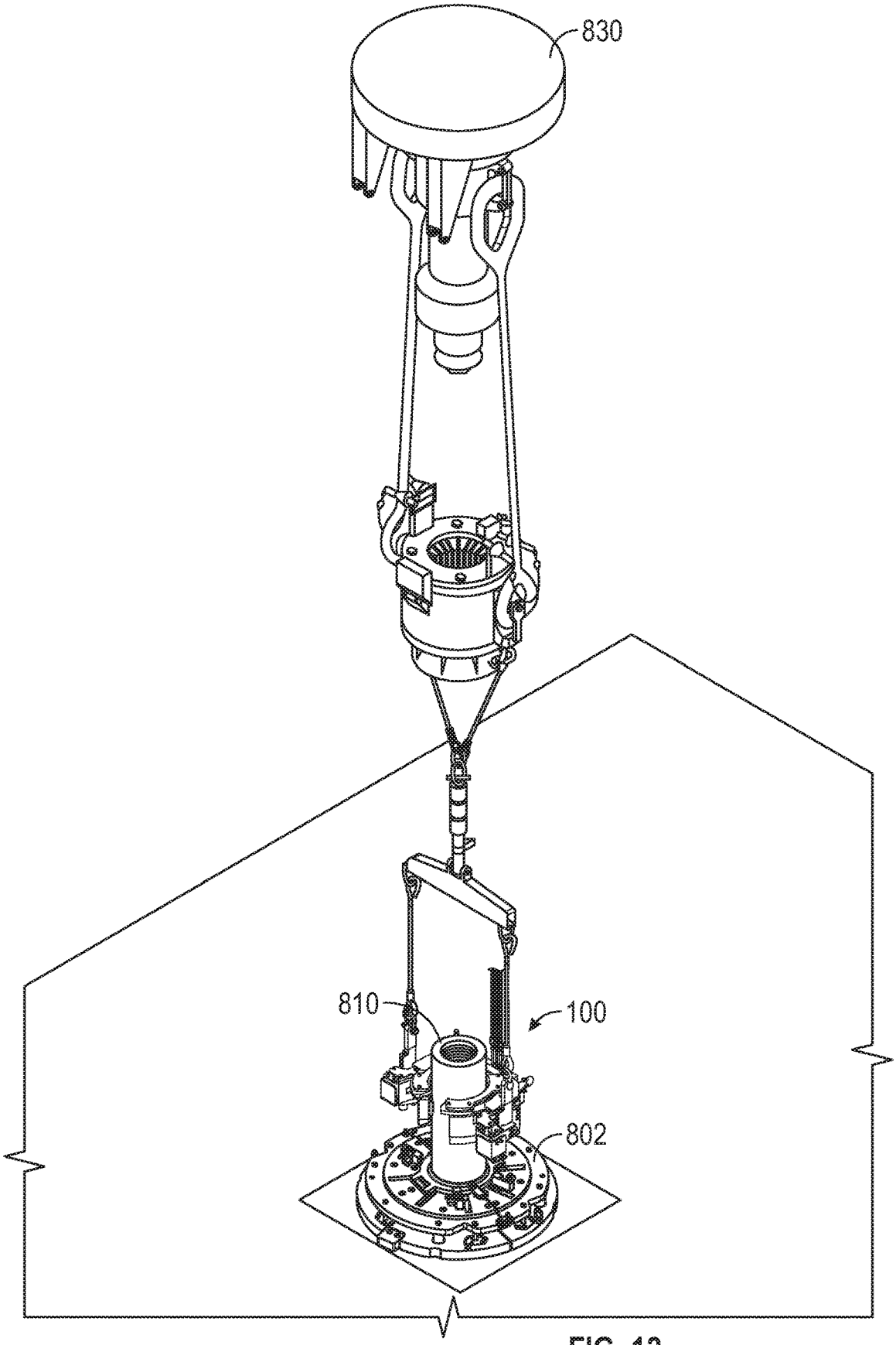
FIG. 12 illustrates a perspective view of the apparatus lowering the first tubular into a spider, according to an embodiment.
Figure 13:
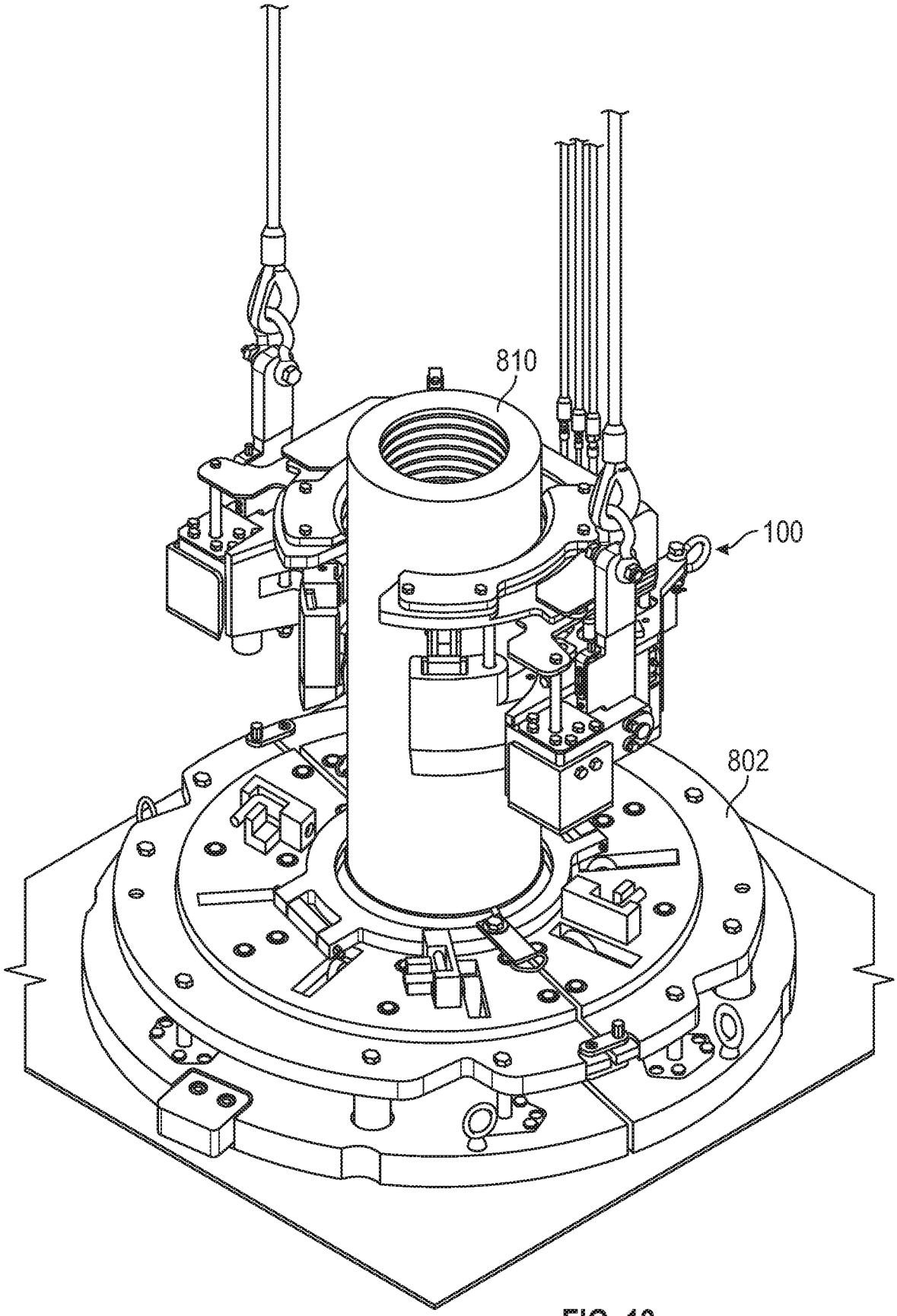
FIG. 13 illustrates a perspective view of the slips of the spider engaging and gripping the first tubular and the slips of the apparatus releasing the first tubular, according to an embodiment.

The method 700 may also include lowering (e.g., stabbing) the first tubular 810 into the spider 802 using the top drive 830, as at 714. This is shown in FIG. 12. The method 700 may also include actuating one or more slips of the spider 802 from a first position to a second position to grip and engage the first tubular 810, as at 716. This is shown in FIG. 13. The method 700 may also include actuating the slips 122 of the apparatus 100 back into the first position and unlocking the slip carriers 120, as at 718.

Figure 14:
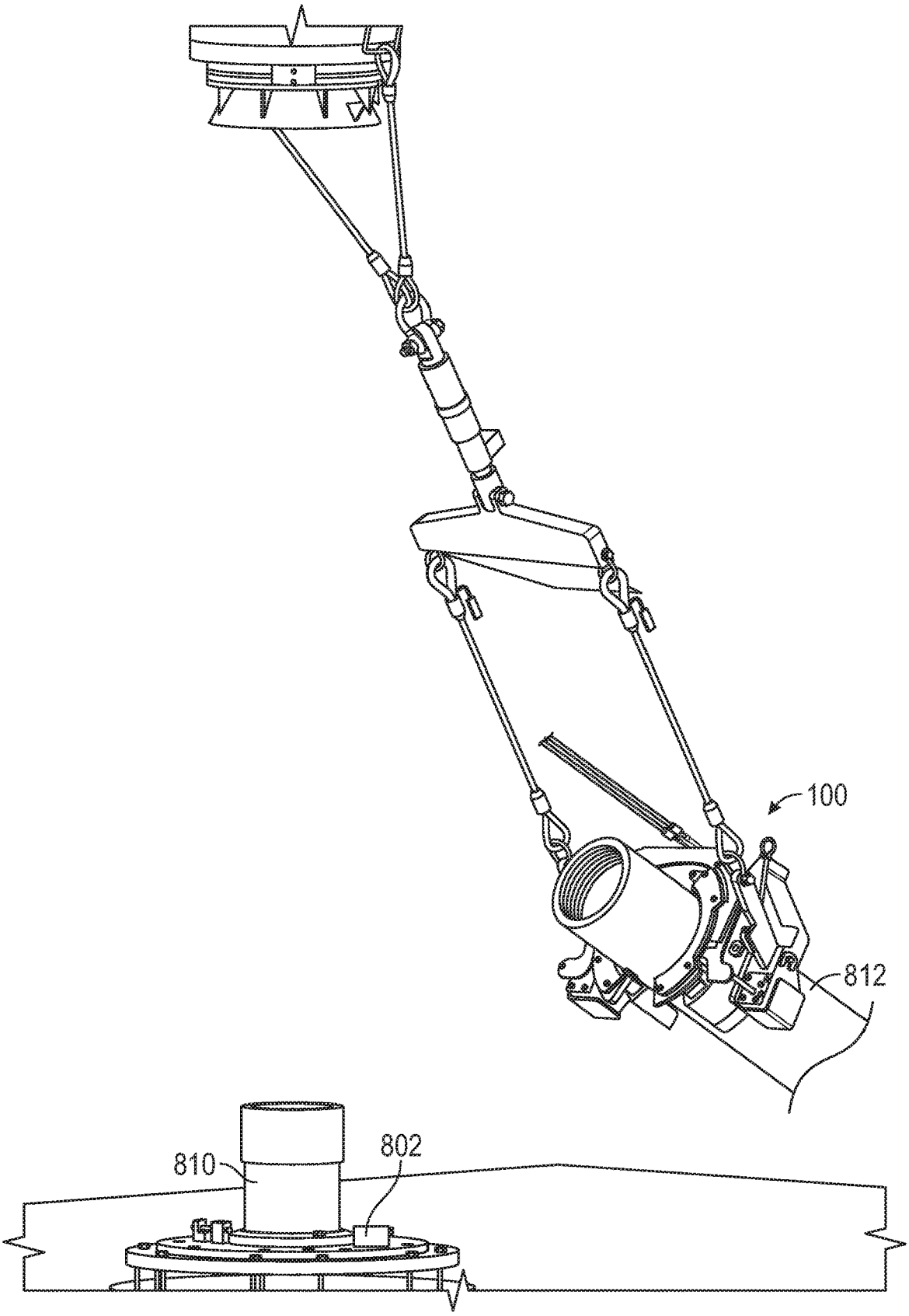
FIG. 14 illustrates a perspective view of the second tubular positioned within the apparatus and the slip carriers in the closed and locked position, according to an embodiment.

The method 700 may also include positioning the apparatus 100 above a second tubular 812 and actuating the slip carriers 120 into the open position, as at 720. The second tubular 812 may be positioned in the V-door. The method 700 may also include positioning the apparatus 100 at least partially around the second tubular 812 and closing and locking the slip carriers 120 around the second tubular 812, as at 722. This is shown in FIG. 14. The method 700 may also include actuating the slips 122 into the second position, as at 724.

Figure 15:
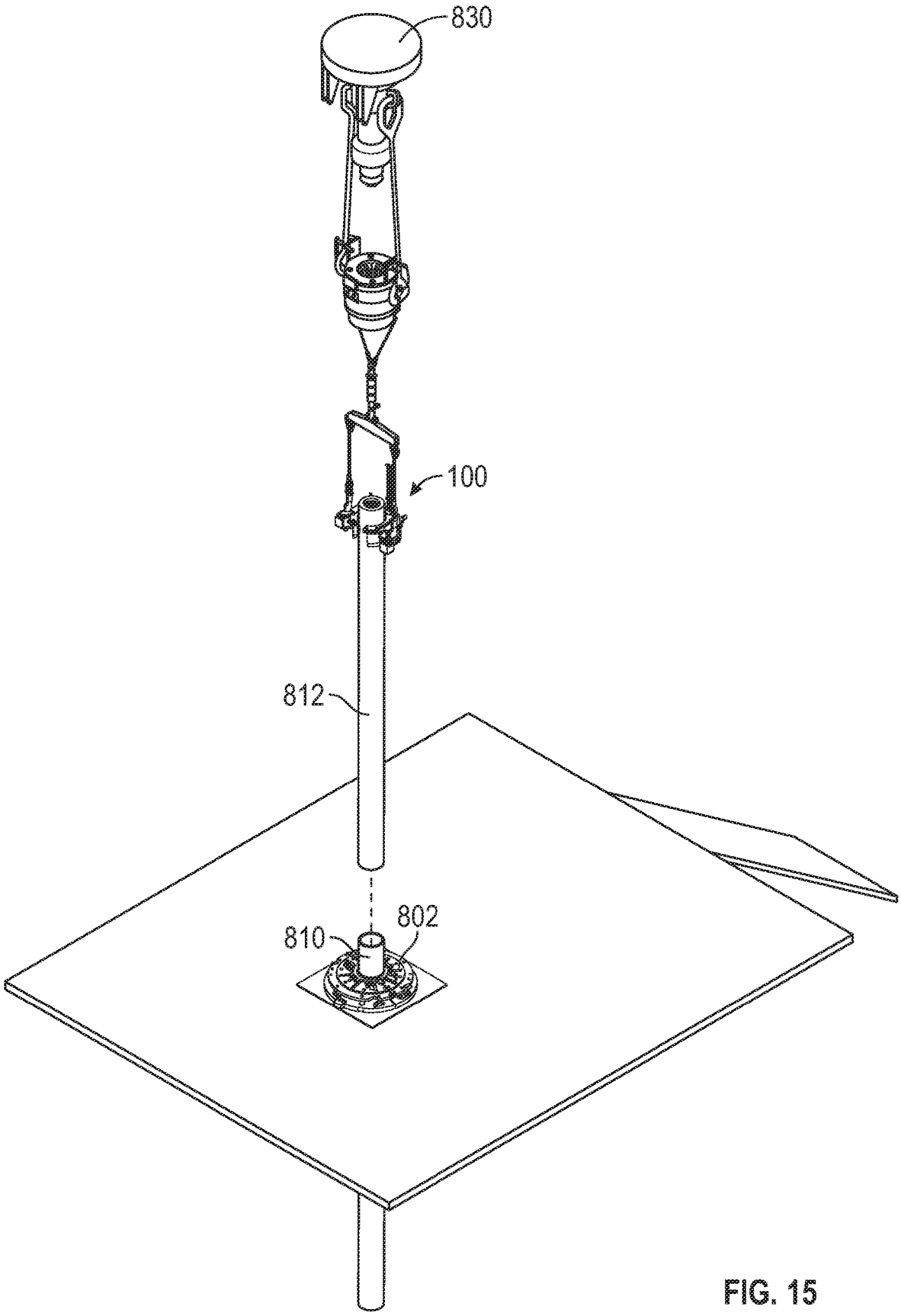
FIG. 15 illustrates a perspective view of the apparatus suspending the second tubular in the vertical orientation over the well center, according to an embodiment.

The method 700 may also include lifting the second tubular 812 into a substantially vertical orientation using the top drive 830 while the second tubular 812 is gripped by the apparatus 100, as at 726. This is shown in FIG. 15. In the substantially vertical orientation, the second tubular 812 may be positioned above and aligned with the well center 800 (e.g., the spider 802). The method 700 may also include lowering the second tubular 812 into contact with the first tubular 810 using the top drive 830, as at 728. More particularly, a pin connection at the lower end of the second tubular 812 may be lowered into a box connection at the upper end of the first tubular 810.

The method 700 may also include coupling (e.g., making up) the first and second tubulars 810, 812, as at 730. The first tubular 810 may be gripped and supported by the spider 802 when the first and second tubulars 810, 812 are coupled together, and the second tubular 812 may be gripped and supported by the apparatus 100 when the first and second tubulars 810, 812 are coupled together. The method 700 may also include actuating the slips of the spider 802 back into the first position (e.g., to release the second tubular 812) and lowering the first and second tubulars 810, 812 using the top drive 830, as at 732. The method 700 may also include actuating the slips of the spider 802 back into the second position to grip the second tubular 812, as at 734. The method 700 may also include actuating the slips 122 of the apparatus 100 back into the first position and unlocking the slip carriers 120, as at 736.

The method 700 may also include positioning the apparatus 100 above a third tubular 814 and actuating the slip carriers 120 into the open position, as at 738. The third tubular 814 may be positioned in the V-door. The method 700 may also include positioning the apparatus 100 at least partially around the third tubular 814 and closing and locking the slip carriers 120 around the third tubular 814, as at 740. The method 700 may also include actuating the slips 122 into the second position, as at 742.

The method 700 may also include lifting the third tubular 814 into a substantially vertical orientation using the top drive 830 while the third tubular 814 is gripped by the apparatus 100, as at 744. In the substantially vertical orientation, the third tubular 814 may be positioned above and aligned with the well center 800 (e.g., the spider 802). The method 700 may also include lowering the third tubular 814 into contact with the second tubular 812 using the top drive 830, as at 746. More particularly, a pin connection at the lower end of the third tubular 814 may be lowered into a box connection at the upper end of the second tubular 812.

Figure 16:
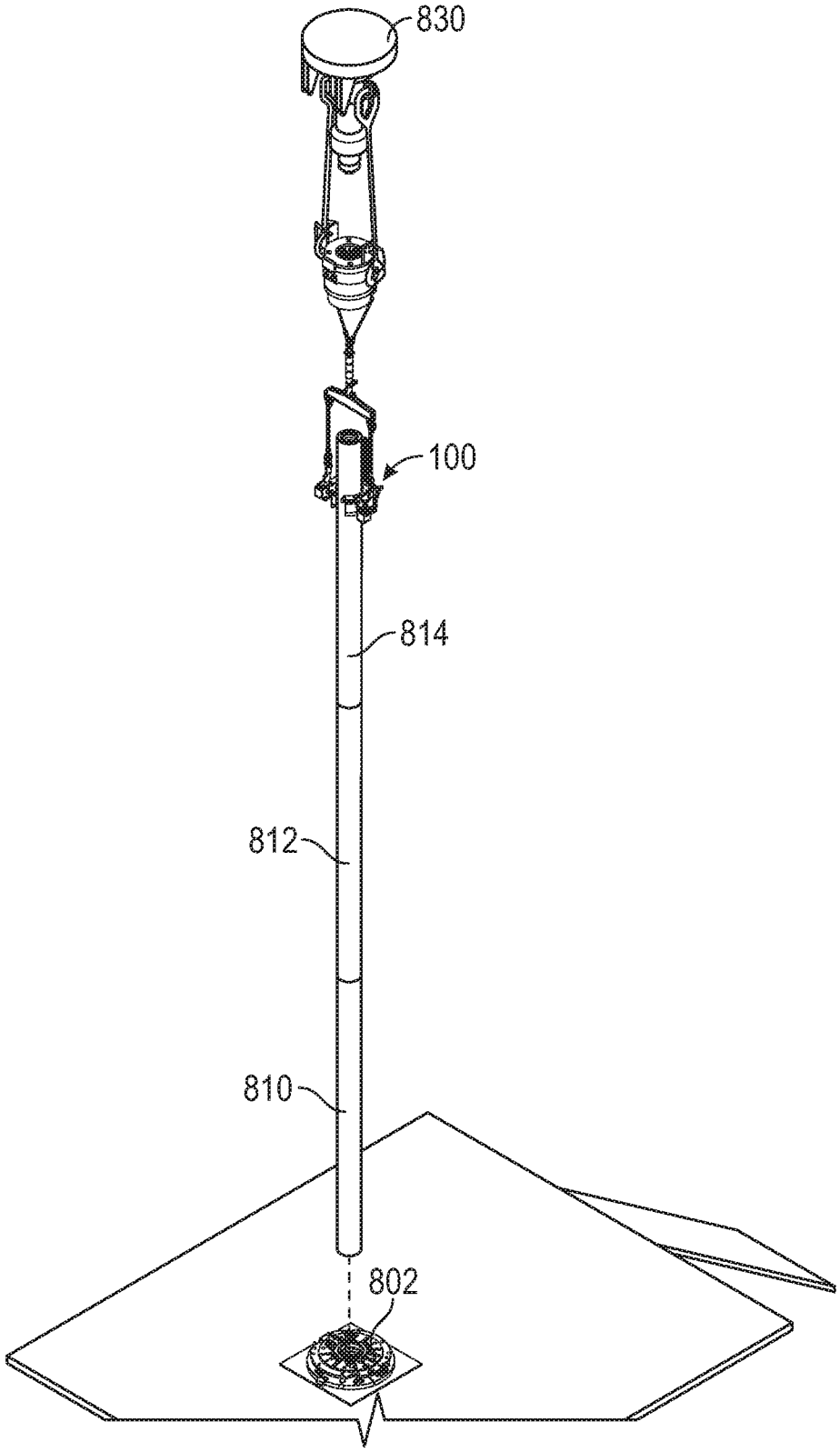
FIG. 16 illustrates a perspective view of the apparatus lifting the first, second, and third tubulars up and out of the spider, according to an embodiment.

The method 700 may also include coupling (e.g., making up) the second and third tubulars 812, 814, as at 748. The second tubular 812 may be gripped and supported by the spider 802 when the second and third tubulars 812, 814 are coupled together, and the third tubular 814 may be gripped and supported by the apparatus 100 when the second and third tubulars 812, 814 are coupled together. The method 700 may also include actuating the slips of the spider 802 back into the first position (e.g., to release the second tubular 812) and lifting the first, second, and third tubulars 810, 812, 814 (i.e., a stand) out of the spider 802 using the top drive 830 while the third tubular 814 is gripped by the apparatus 100, as at 750. This is shown in FIG. 16.

Figure 17:
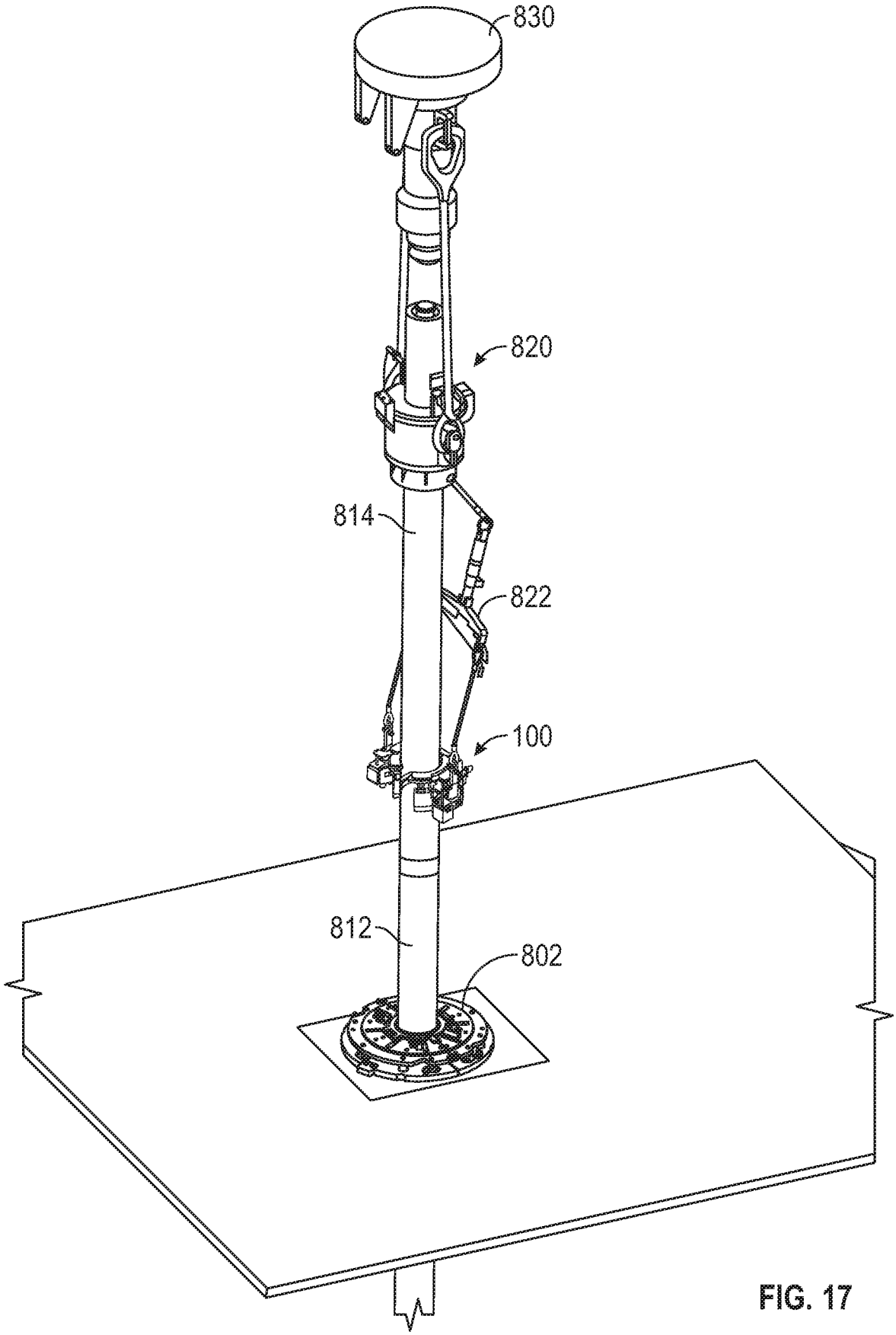
FIG. 17 illustrates the apparatus and an elevator being lowered such that the elevator is positioned around and grips the third tubular, according to an embodiment.

In an alternative embodiment, after the second and third tubulars 812, 814 are coupled together, the method 700 may include actuating the slips 122 of the apparatus 100 back into the first position to release the third tubular 814, as at 752. The method 700 may also include unlocking and opening the slip carriers 120, as at 754. The method 700 may also include lowering an elevator 820 until the third tubular 814 is positioned at least partially therein using the top drive 830, as at 756. This is shown in FIG. 17. The elevator 820 may be positioned above the apparatus 100 and coupled thereto by one or more linkages 822. Thus, the apparatus 100 and the elevator 820 may be lowered together until the third tubular 814 is positioned at least partially within the elevator 820. The method 700 may also include actuating slips of the elevator 820 from a first position into a second position to grip the third tubular 814, as at 758.

Figure 18:
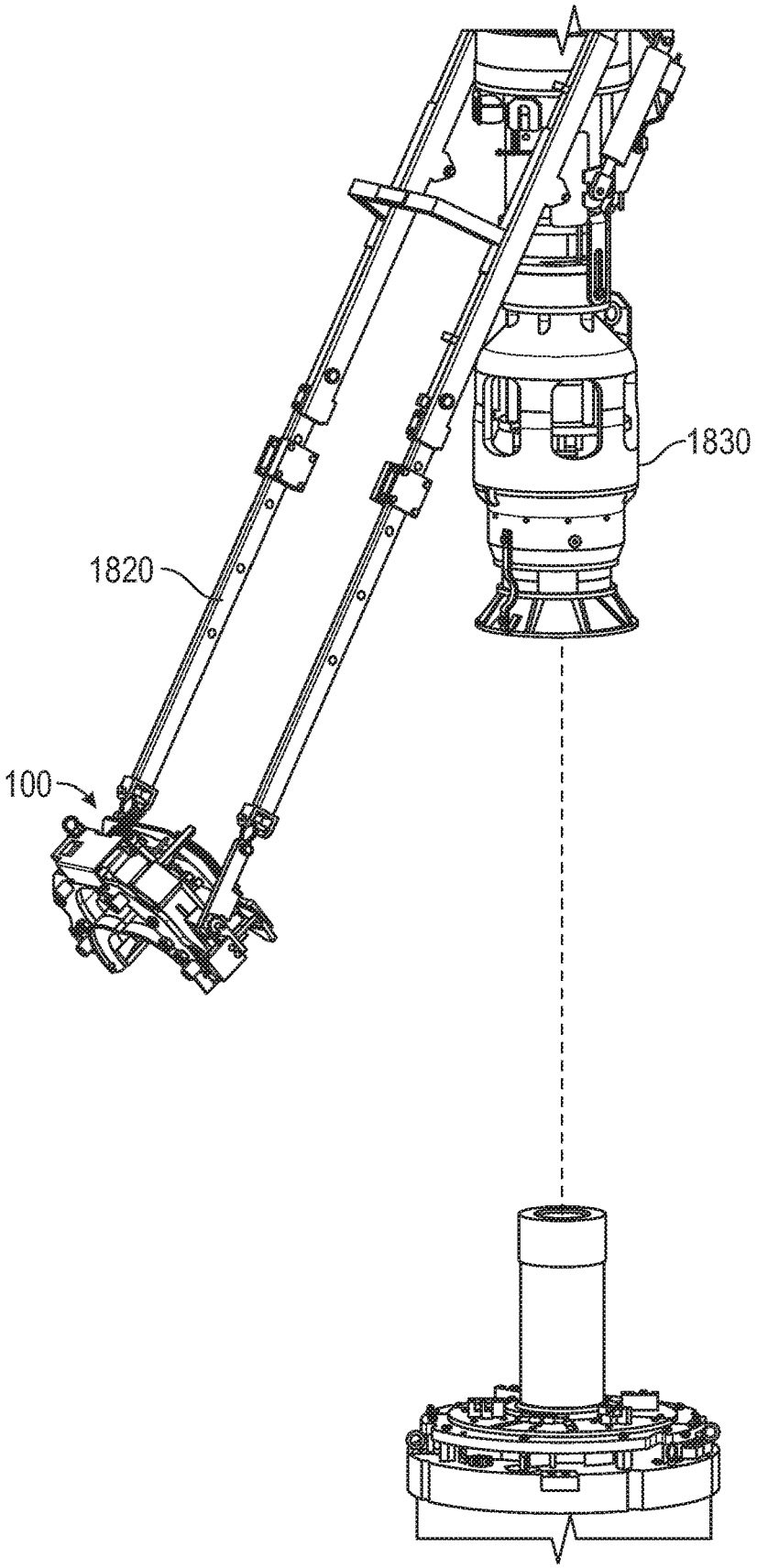
FIG. 18 illustrates a pair of arms coupled to and positioned between the apparatus and a casing running tool, according to an embodiment.
Figure 20:
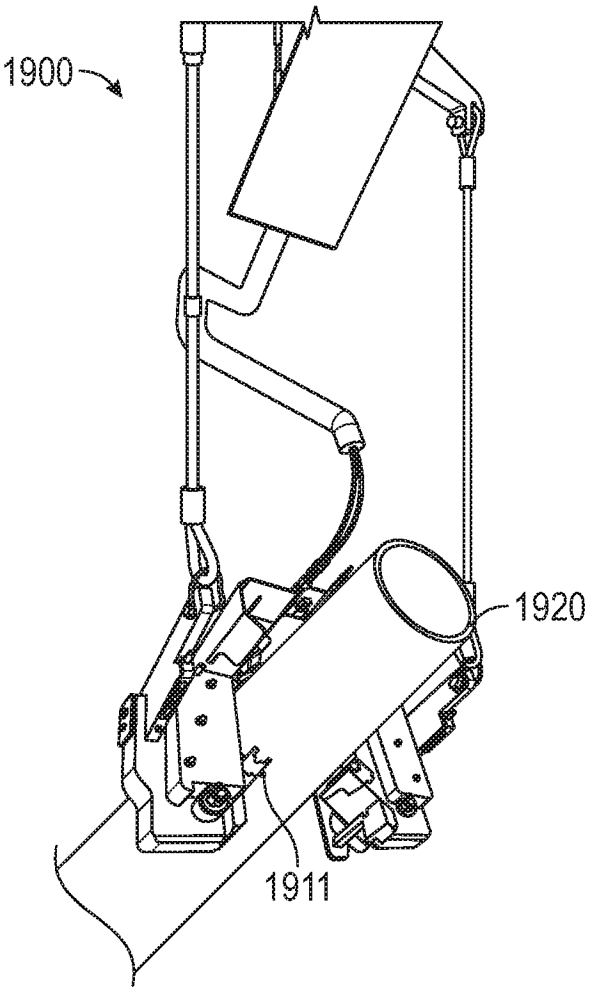
FIG. 20 illustrates a perspective view of the apparatus shown in FIG. 19 gripping a tubular, according to an embodiment.
Figure 19:
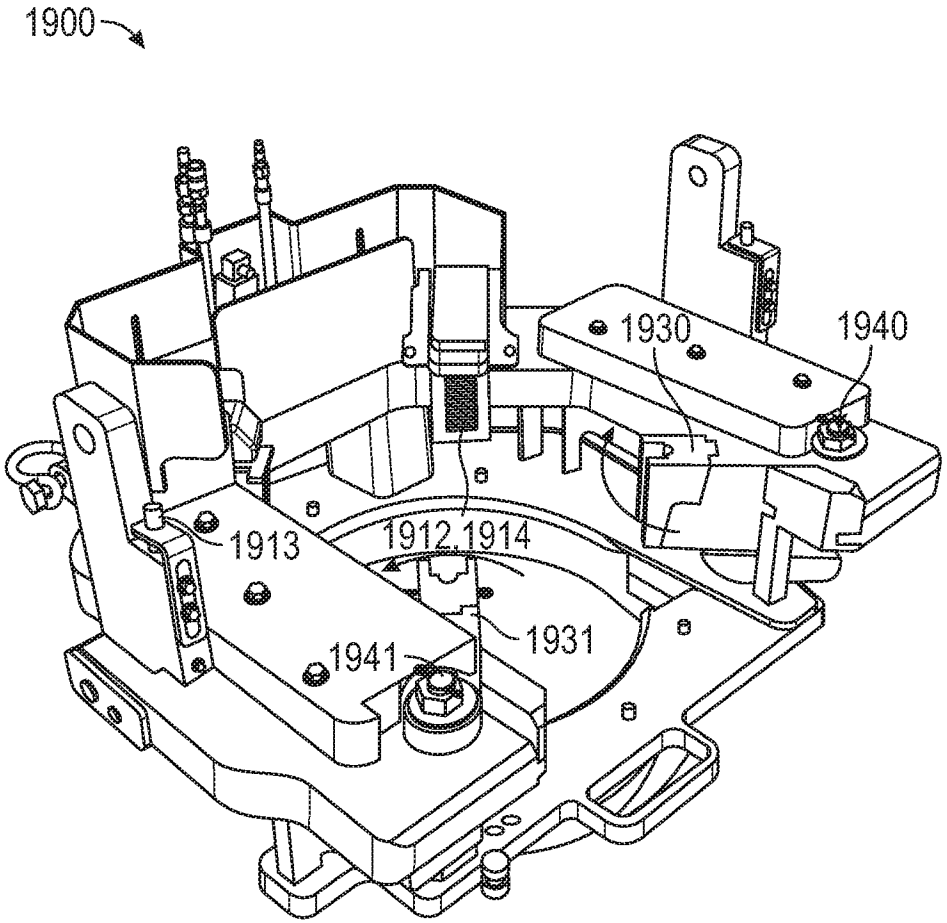
FIG. 19 illustrates a perspective view of a prior art apparatus, according to an embodiment.

The apparatus 100 may also be used on pipe pick-up arms, such as on a casing running tool ("CRT"). The specific rig type and application may determine whether a CRT is used or a conventional elevator is used, and the rig-up of the apparatus 100 may be determined by this selection. FIG. 18 illustrates a CRT application of the apparatus 100. The arms 1820 may tilt/luff out to move the apparatus 100 toward a tubular. The CRT 1830 may then be lowered to position the apparatus 100 at least partially around the tubular while the arms 1820 are tilted/luffed out. The arms 1820 may then be moved/tilted back in to cause the tubular to take a substantially vertical orientation. The CRT 1830 may then be lowered onto the tubular.

Figure 21A:
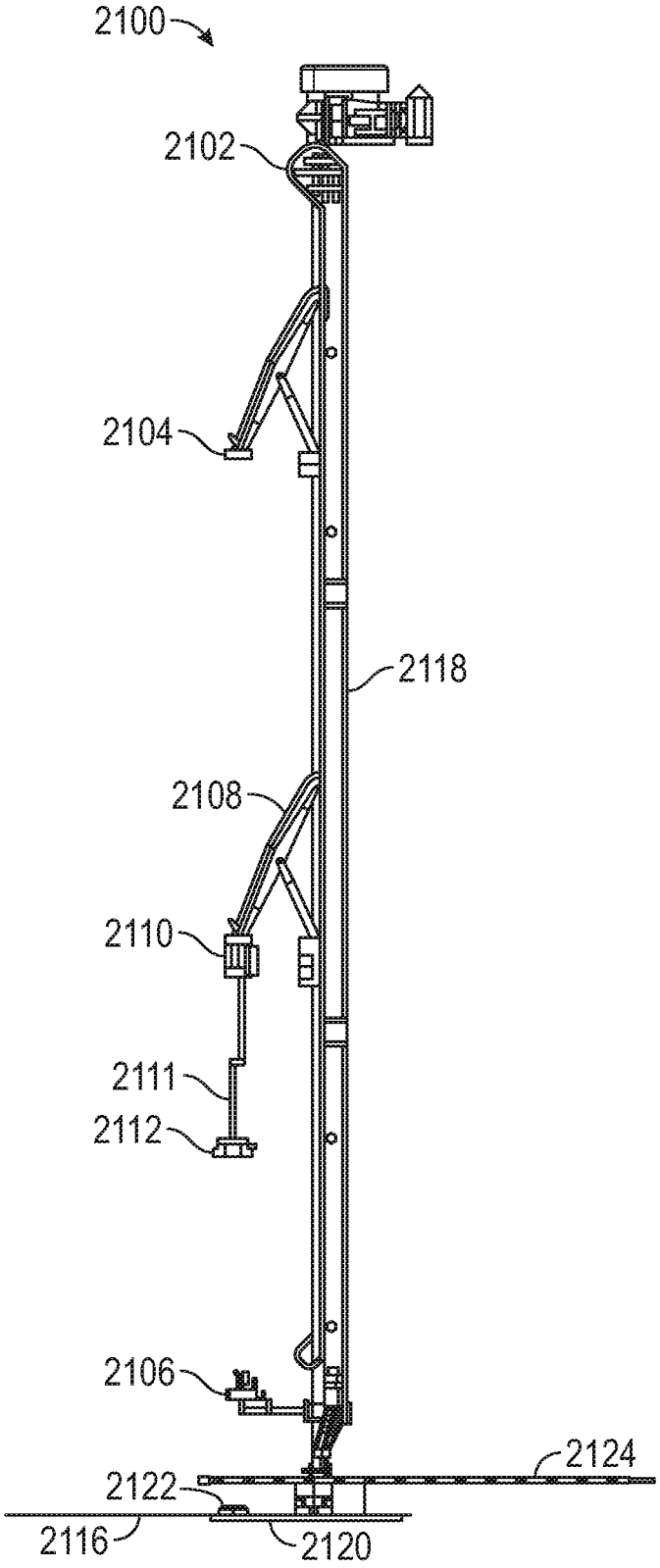
FIG. 21A illustrates a side, elevation view of a pipe racking system equipped with the apparatus at a first stage of operation, according to an embodiment.

FIG. 21A illustrates a side, elevation view of a pipe racking system (PRS) 2100, according to an embodiment. The pipe racking system 2100 generally includes a driver (e.g., a winch 2102), one or more guide arms (e.g., an upper guide arm 2104 and a lower guide arm 2106), a main arm 2108, a gripper head (or "gripper") 2110, and an elevator 2112 suspended from the gripper 2110 or the distal end of the main arm 2108 via one or more suspension arms 2111. This assembly is movable up and down, relative to a rig floor 2116 along a vertical column 2118 that extends upward from the rig floor 2116, e.g., by operation of the winch 2102. Further, a well or mousehole 2120 is defined in the rig floor 2116. A spider 2122 or other such rig floor equipment may be positioned in the well or mousehole 2120.

The elevator 2112 may be a horseshoe-type slip elevator, such as an embodiment of the apparatus 100 discussed above. In other embodiments, the elevator 2112 may be any other type of elevator that is configured to grip an outer diameter surface of a tubular 2124, rather than a lifting nubbin or other type of coupling that is connected to the tubular 2124. The elevator 2112 may be remotely controlled, such that its slips may be set in response to a signal sent from a control console. Likewise, the various other components of the pipe racking system 2100, in particular the winch 2102, may be remotely controlled via the console, so as to allow the various components of the pipe racking system 2100 to be moved up and down and/or otherwise articulated using one or more consoles (e.g., a single console).

Figure 21B:
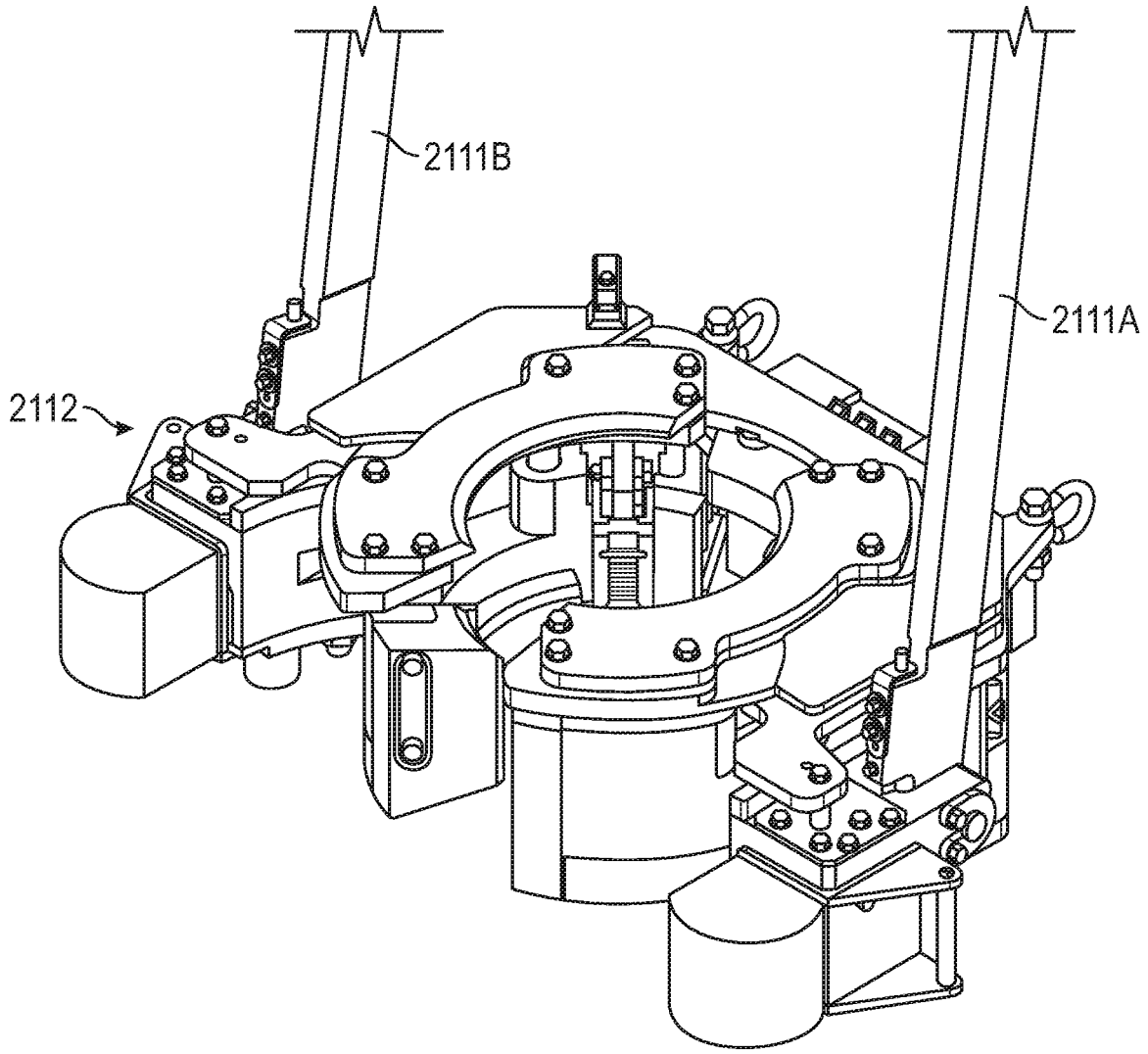
FIG. 21B illustrates a perspective view of an elevator coupled to suspension arms of the pipe racking system, according to an embodiment.

FIG. 21B illustrates a perspective view of the elevator 2112 coupled with two suspension arms 2111A, 2111B, according to an embodiment. The suspension arms 2111A, 2111B may take the place of or be connected to the lift points 114, 115 (see, e.g., FIG. 1). Further, as shown, the suspension arms 2111A, 2111B may be rigid (e.g., rectangular cross-section) plates or bars. The elevator 2112 may be pivotally connected to the suspension arms 2111A, 2111B so as to engage tubulars in various different orientations, as will be described in greater detail below. Although rigid bars are shown, it will be appreciated that the suspension arms 2111A, 2111B may instead be provided as flexible structures, e.g., sling assemblies.

The elevator 2112 may be connected directly to the gripper 2110 and/or the distal end of the main arm 2108 via the suspension arms 2111A, 2111B.

Figure 22:
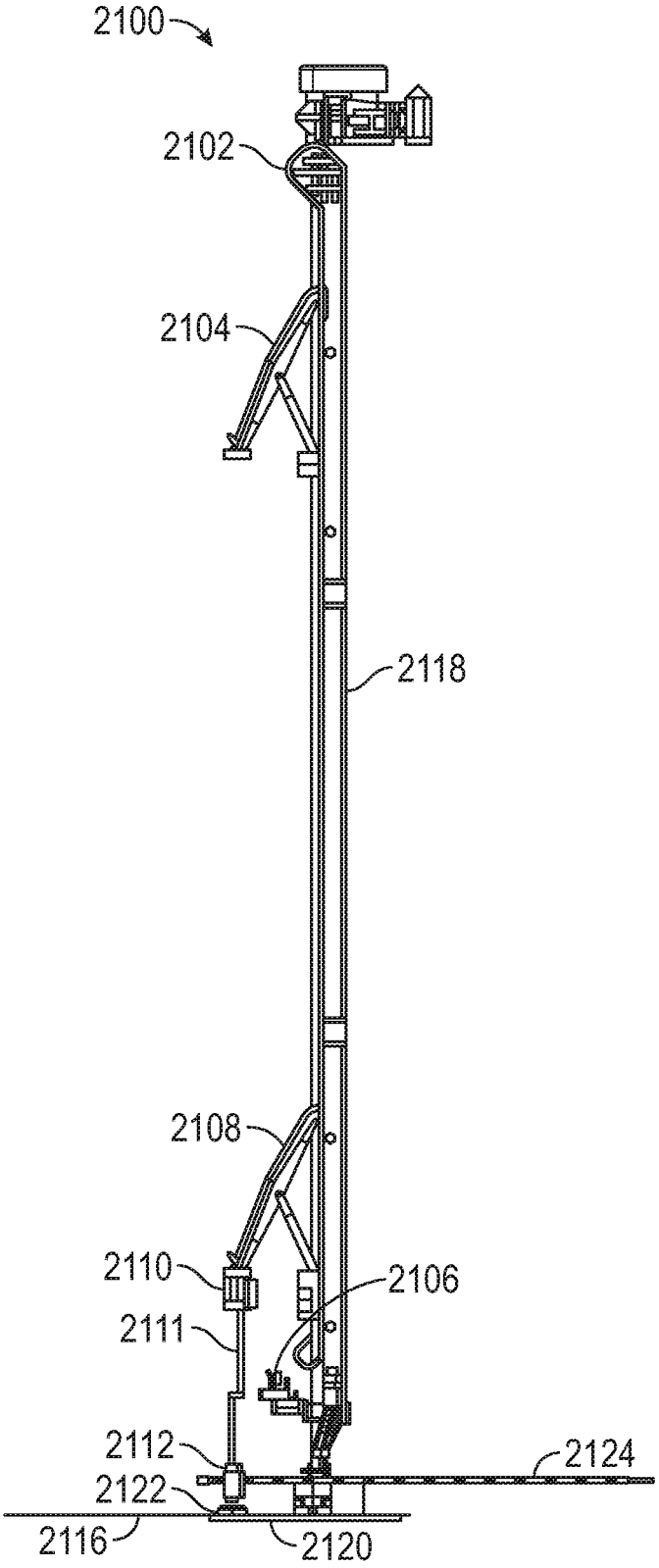
FIG. 22 illustrates a side, elevation view of the pipe racking system equipped with the apparatus at a second stage of operation, according to an embodiment.
Figure 23:
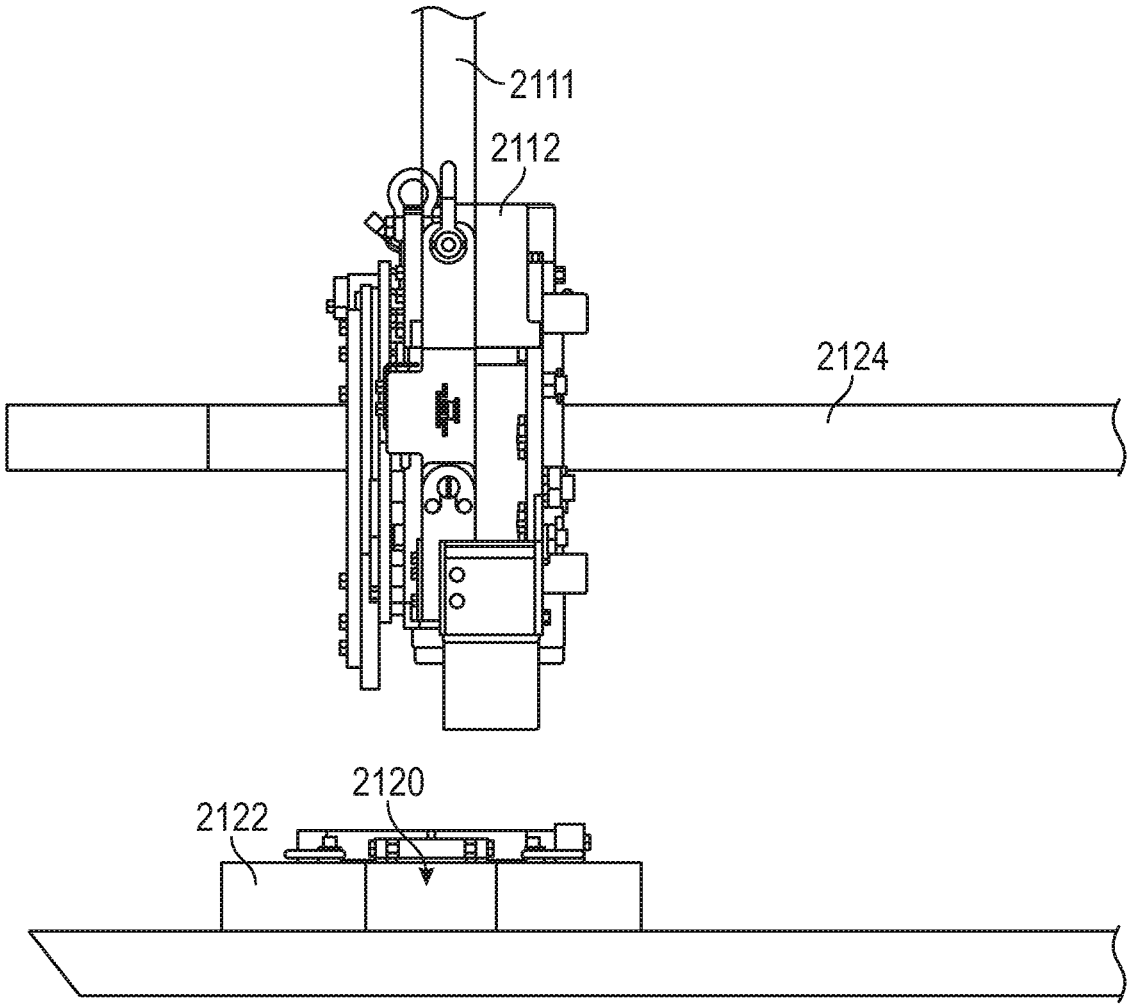
FIG. 23 illustrates a side view of the apparatus installed in a pipe racking system engaging a horizontally-oriented tubular, according to an embodiment.

Referring now to FIG. 22, the elevator 2112 may be lowered toward the rig floor 2116 by moving the main arm 2108 downwards along the column 2118, toward the rig floor 2116. The add-on tubular 2124 may be positioned on a pipe conveyor or another structure configured to bring the tubular 2124 into position for the elevator 2112 to grip the tubular 2124. As shown, prior to being engaged by the elevator 2112, the tubular 2124 may be in a generally horizontal orientation. The elevator 2112 may thus be pivoted by 90 degrees, as shown in FIG. 23, such that its opening faces downward, as it is lowered onto and around the tubular 2124. The slips (e.g., slips 122 of FIG. 1) of the elevator 2112 are then set on the tubular 2124 in response to a remote-control signal sent by the driller from a control console. The elevator 2112 has now engaged the tubular and can support it via radial gripping of the tubular, as opposed to the shoulder-type elevators which rely on a coupling or a lift nubbin (in the case of flush tubulars) to engage and lift the tubular.

Figure 24:
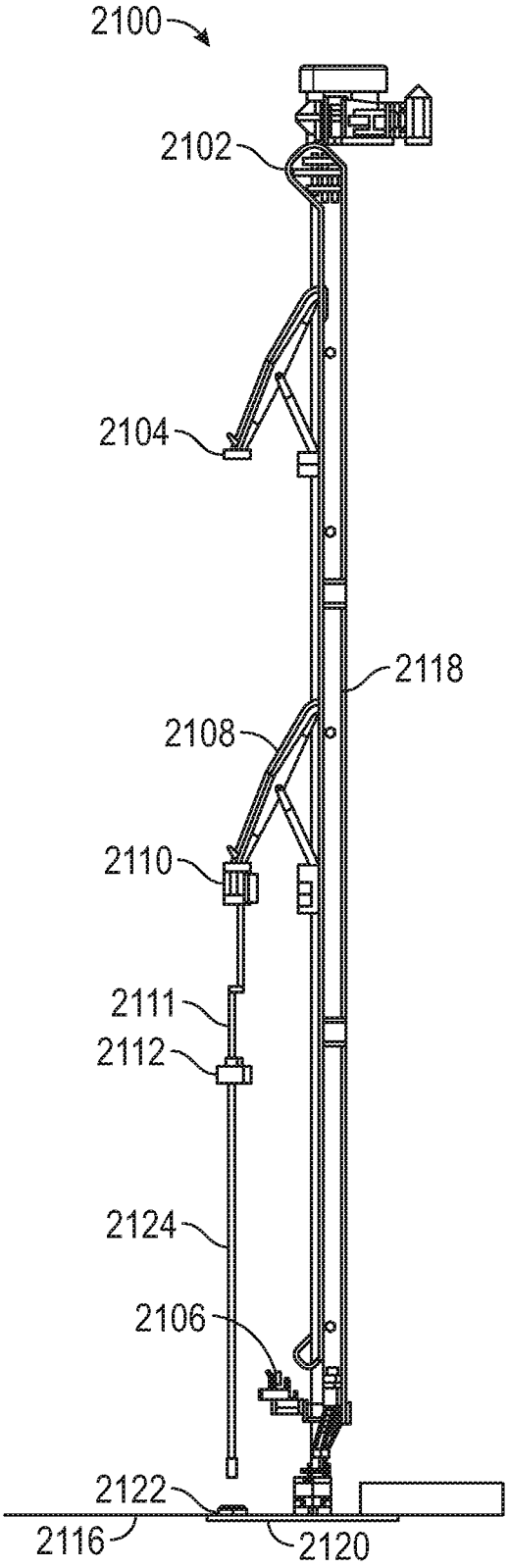
FIG. 24 illustrates a side, elevation view of the pipe racking system equipped with the apparatus at a third stage of operation, according to an embodiment.

Moving to FIG. 24, once the elevator 2112 engages the tubular 2124, the main arm 2108 may move upward, away from the rig floor 2116 and along the column 2118, bringing the elevator 2112 and the tubular 2124 with it. During this upward movement, the elevator 2112 may pivot by 90 degrees, allowing the tubular 2124 to hang vertically, once the elevator 2112 has lifted the tubular 2124 far enough away from the rig floor 2116 to allow the lower end of the tubular 2124 to clear the rig floor 2116.

Figure 25:
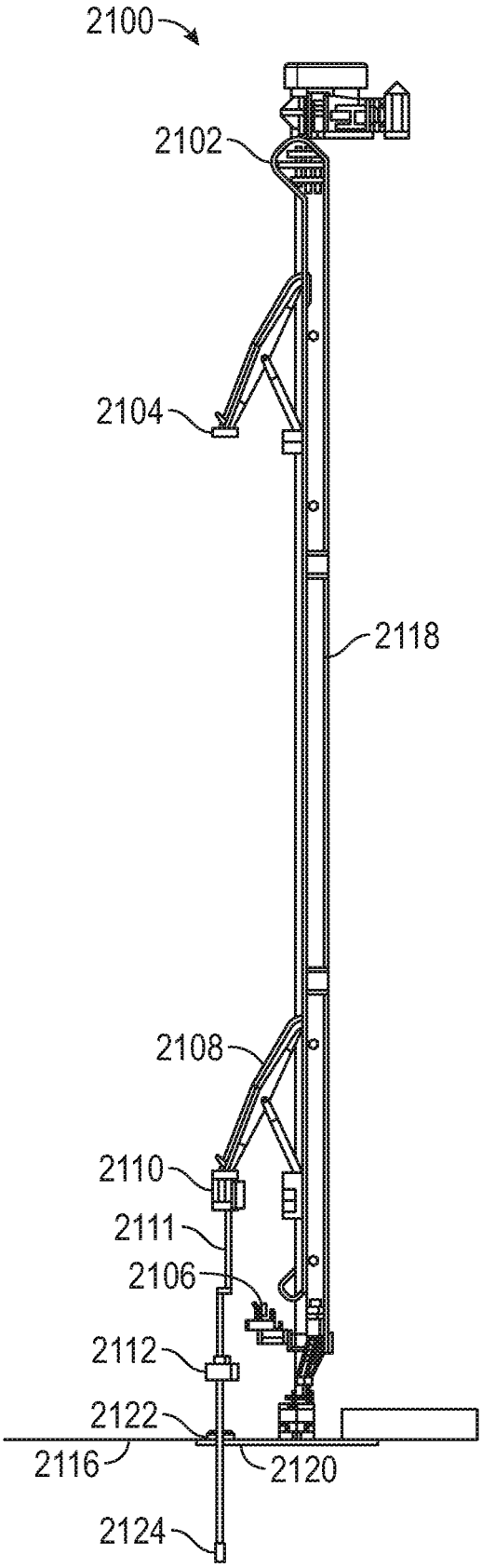
FIG. 25 illustrates a side, elevation view of the pipe racking system equipped with the apparatus at a fourth stage of operation, according to an embodiment.

Continuing to FIG. 25, while still supporting the tubular 2124, the main arm 2108 may then be moved downward, thereby lowering the tubular 2124 into the well (or mousehole) 2120 through the spider 2122. The tubular 2124 is then gripped by the spider 2122 at the rig floor 2116. It will be appreciated that the spider 2122 may be substituted with a floating mousehole or any other device for supporting the tubular 2124. Once the weight of the tubular 2124 has been transferred to the spider 2122 (or another supporting device) at the rig floor 2116, the elevator 2112 may release the tubular 2124. Because the elevator 2112 is controlled via connection to a remote control console, the elevator 2112 may be opened via activation from the remote control console.

The next tubular is picked up from horizontal at this point and lifted into a vertical position, in the same sequence as the first tubular 2124. The second tubular may then be lowered until its pin-end enters the box-end of the first tubular 2124 and makes contact therewith. At this point the lower guide arm 2106 may be deployed to steady the second tubular. Once the guide arm 2106 is steadying the tubular, the elevator 2112 may be disengaged from the second tubular. The second tubular can then be rotated relative to the first tubular 2124, e.g., using a power tong, so as to connect the two tubulars together. If forming a stand of three joints, the two tubulars may be lowered again into the wellbore or mousehole 2120 and engaged by the spider 2122. A third joint is then picked up and the process is repeated. If forming a stand of four joints, the process is repeated again.

Figure 26:
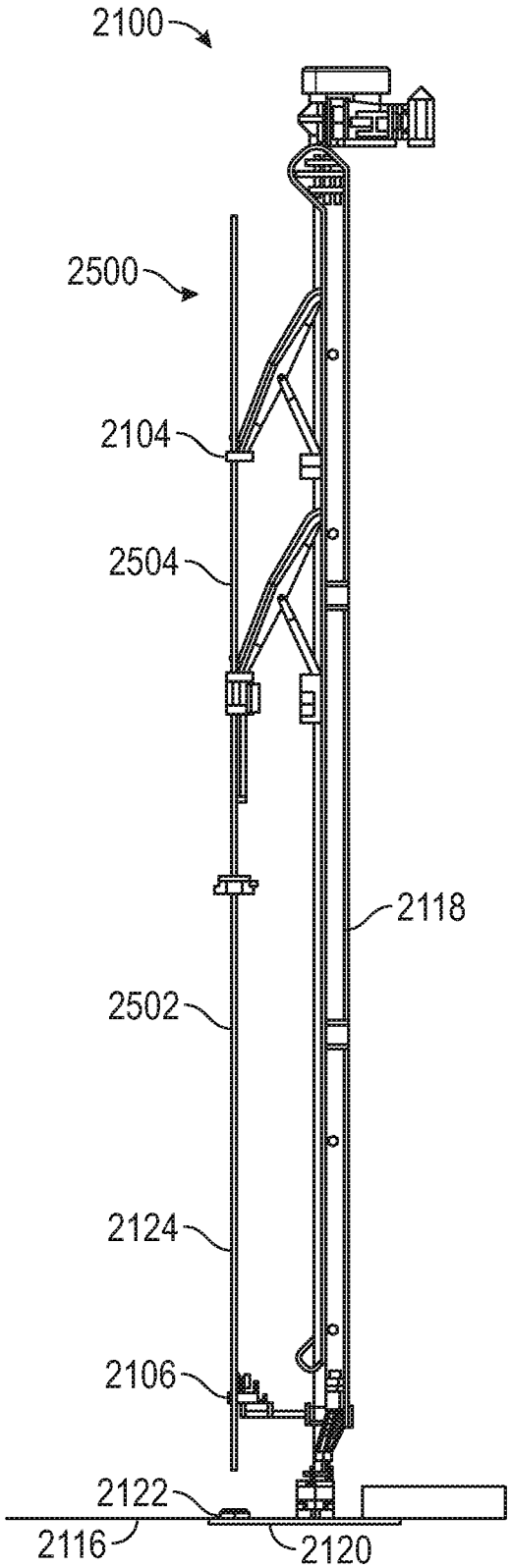
FIG. 26 illustrates a side, elevation view of the pipe racking system equipped with the apparatus at a final stage of lifting an assembled stand, according to an embodiment.
Figure 27:
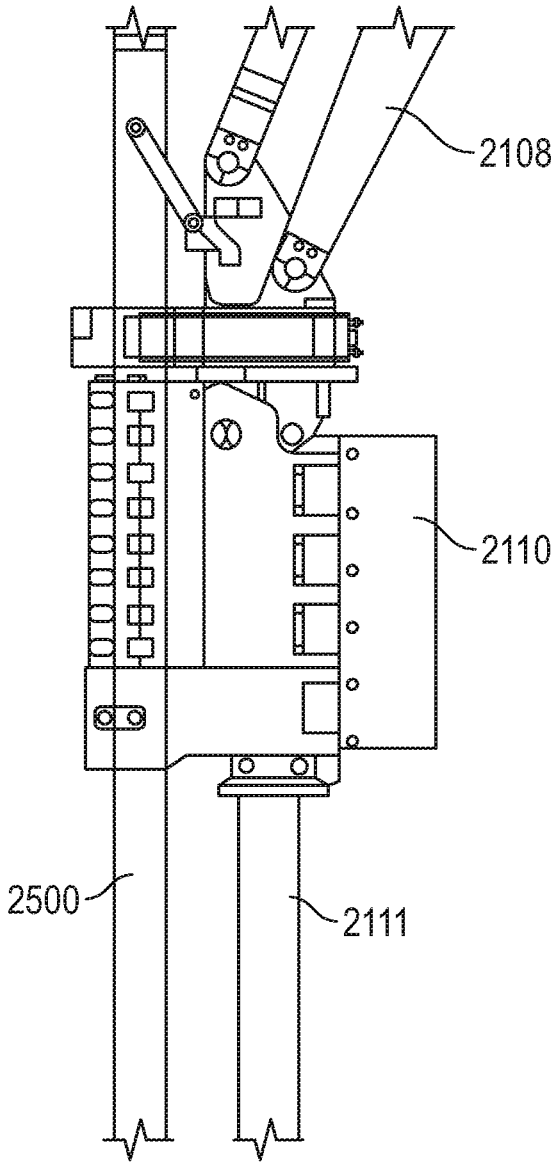
FIG. 27 illustrates a side view of a gripping head of the pipe racking system engaging a stand, according to an embodiment.

FIG. 26 shows a completed stand 2500 supported by the pipe racking system 2100. In this case, the stand 2500 includes three tubulars 2124, 2502, 2504, connected together end-to-end as explained above. Once the third tubular 2504 is connected to the second tubular 2502, the entire stand 2500 is withdrawn from the well or mousehole 2120, upward to the position shown. This is accomplished by gripping the stand 2500 using the gripper 2110 (as shown in greater detail in FIG. 27) and moving the main arm 2108 upward until the entire stand 2500 is raised out of the wellbore or mousehole 2120. At this time, both the upper and lower guide arms 2104, 2106 may engage the stand 2500, thereby maintaining the stand in the upright, vertical orientation shown. The stand 2500 is now ready for vertical storage within pipe racks located on the rig floor 2116 nearby the pipe racking system 2100.

The entire stand (made up of three tubulars) is supported at the gripper 2110. The upper and lower guide arms 2104, 2106, while engaging the stand 2500 do not support the axial load of the stand 2500. Rather, the upper and lower guide arms 2104, 2106 serve to guide the stand 2500 as it is racked back into a stored location.

Figure 28:
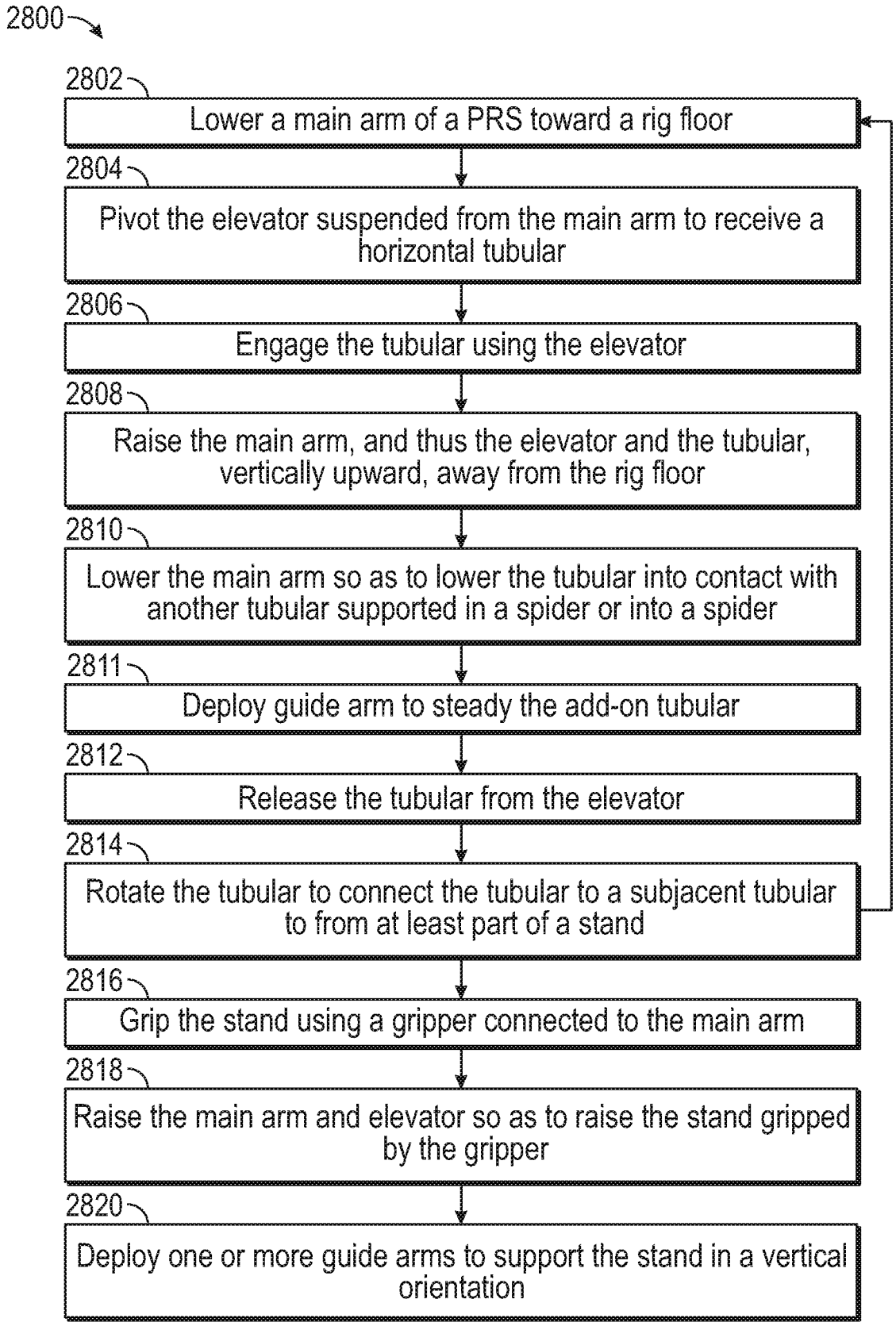
FIG. 28 illustrates a flowchart of a method for stand building, according to an embodiment.

FIG. 28 illustrates a flowchart of a method 2800 for stand building, according to an embodiment. The method 2800 may proceed by operation of the pipe racking system 2100, as discussed above with respect to FIGS. 21A-27. The method 2800 may begin with the pipe racking system 2100 positioned as shown in FIG. 21A, with the elevator 2112 above a rig floor 2116. The method 2800 may thus include lowering a main arm 2108 toward the rig floor 2116, as at 2802. As discussed above, the main arm 2108 has a gripper 2110 coupled to an end of the main arm 2108. Further, an elevator 2112 is suspended from the gripper 2110 or the distal end of the main arm by one or more suspension arms 2111. The suspension arms 2111 may be rigid bars, or may be flexible, according to various embodiments.

The method 2800 may then include pivoting the elevator 2112 so as to receive a tubular 2124 into a throat of the elevator 2112, as at 2804 and as shown in FIG. 22. At this point, the tubular 2124 may be in a substantially horizontal orientation, e.g., parallel to the rig floor 2116, as shown.

The method 2800 may then proceed to engaging the tubular 2124 using slips 122 (see FIG. 1) of the elevator 2112, as at 2806. For example, the tubular 2124 may be received laterally into the slip carrier 120, and the slip carrier 120 may be pivoted to shut the elevator 2112 around the tubular 2124. A signal may then be sent from a remote control console which may cause the slips 122 to lower in the slip carrier 120 and thereby engage the tubular 2124.

With the elevator 2112 engaging the tubular 2124, the method 2800 may then proceed to raising the main arm 2108 with respect to the rig floor 2116, as at 2808. This is shown in FIG. 24. Raising the main arm 2108 causes the elevator 2112 and the tubular 2124 engaged by the elevator 2112 to raise vertically upward from the rig floor 2116, and may bring the tubular 2124 into a vertical orientation, parallel to the vertical column 2118.

The method 2800 may then proceed to lowering the tubular 2124 into contact with another tubular or into a spider 2122, by lowering the main arm 2108 and the elevator 2112, as at 2810. In either case, the spider 2122 may then engage the tubular 2124, e.g., again in response to a signal from the console. The method 2800 may then include deploying the lower guide arm until it contacts and steadies the tubular (unless it is the first tubular of the stand), as at 2811.

The method 2800 may then include releasing the elevators 2112 grip on the tubular 2124 while the lower guide arm steadies the tubular 2124, as at 2812, e.g., in response to a signal from the console. For example, the slips 122 may be raised relative to the slips carrier 120, thereby retracting the slips 122 from engagement with the tubular 2124.

With the elevator 2112 released from the tubular 2124, the tubular 2124 may be rotated to connect with a subjacent tubular (e.g., one that has already been run into the wellbore 2120 (or mousehole), as at 2814. This may secure a connection between the tubulars and thereby form at least part of a stand 2500 (see FIG. 26). When the tubular 2124 is the first tubular of the stand, it may simply be lowered through the spider 2122 and engaged thereby until connected with a subsequent tubular, as explained above. If another tubular is to be connected to form the stand 2500, the main arm 2108 may be raised, and the method 2800 may loop back to then lowering the elevator to engage the next tubular at 2802.

Once a desired number of tubulars are connected together to form the stand 2500, the stand 2500 may be gripped using the gripper 2110 or the elevator 2112, as at 2816, and as shown in FIG. 25. The stand 2500 may be raised to the position shown in FIG. 26 by raising the main arm 2108 along the vertical column 2118, e.g., by operation of the winch 2102, as at 2818. While the stand 2500 is in the vertical position, guide arms 2104, 2106 may be deployed, as at 2820, to maintain the vertical orientation of the stand 2500. The stand 2500 may then be positioned into a storage rack ("racked back") for later use.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

While the present teachings have been illustrated with respect to one or more implementations, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A method for building a stand of tubulars, comprising:

lowering a main arm of a pipe racking system toward a rig floor along a vertical column, wherein the pipe racking assembly comprises a gripper coupled to an end of the main arm, and an elevator suspended from the gripper or end of the main arm by one or more suspension arms;

pivoting the elevator so as to receive a first tubular into a throat of the elevator;

engaging the first tubular using slips of the elevator;

raising the main arm with respect to the rig floor, wherein raising the main arm causes the elevator and the first tubular engaged by the elevator to raise;

lowering the tubular into a well or mousehole by lowering the main arm and the elevator;

gripping and supporting the first tubular at the well or mousehole using a supporting device;

releasing the first tubular from the elevator;

pivoting the elevator so as to receive a second tubular into a throat of the elevator;

engaging the second tubular using slips of the elevator;

raising the main arm with respect to the rig floor, wherein raising the main arm causes the elevator and the second tubular engaged by the elevator to raise;

lowering the second tubular into contact with the first tubular by lowering the main arm and the elevator;

rotating the second tubular with respect to the first tubular, to secure a connection therebetween and thereby form at least part of a tubular stand;

gripping the tubular stand using the gripper; and raising the tubular stand by raising the main arm along the vertical column.

2. The method of claim 1, wherein engaging the add-on tubular using the elevator comprises sending a signal to the elevator from a remote control console.

3. The method of claim 1, wherein the one or more suspension arms comprise one or more rigid arms extending from the gripper or the distal end of the main arm to the elevator and pivotally coupled to the elevator.

4. The method of claim 1, further comprising maintaining a vertical orientation of the tubular stand along the column after releasing the tubular form the elevator using one or more guide arms coupled to the vertical column.

5. The method of claim 1, wherein engaging the add-on tubular using the elevator comprises:

positioning a slip carrier of the elevator at least partially around the tubular;

pivoting the slip carrier into a closed and locked position, wherein the slip carrier is pivoted with respect to a body of the elevator; and actuating slips coupled to the slip carrier from a first position into a second position to grip the add-on tubular.

6. The method of claim 5, wherein actuating the slip carrier into the closed and locked position prevents the first tubular from being removed laterally from the elevator, and wherein the slip carrier pivots into the closed and locked position without manual intervention or powered actuators.

* * * * *